United States Patent [19]

Nakada et al.

[11] 4,402,244

[45] Sep. 6, 1983

[54] AUTOMATIC PERFORMANCE DEVICE WITH TEMPO FOLLOW-UP FUNCTION

[75] Inventors: Akira Nakada, Hamamatsu; Eisaku Okamoto, Hamakita; Kiyoshi Yoshida, Hamamatsu, all of Japan

[73] Assignee: Nippon Gakki Seizo Kabushiki Kaisha, Hamamatsu, Japan

[21] Appl. No.: 267,688

[22] Filed: May 28, 1981

[30] Foreign Application Priority Data

Jun. 11, 1980 [JP] Japan ..... 55/78784
Jun. 18, 1980 [JP] Japan ..... 55/82506

[51] Int. Cl.[3] ..... G10F 1/00

[52] U.S. Cl. ..... 84/1.03; 84/478; 84/470 R

[58] Field of Search ..... 84/478, 1.01, 470 R, 84/1.03

[56] References Cited

U.S. PATENT DOCUMENTS 3,255,292 6/1966 Park ..... 84/1.03
4,012,979 3/1977 Wemekamp ..... 84/478
4,321,853 3/1982 Tumblin ..... 84/470 R

*Primary Examiner*—J. V. Truhe
*Assistant Examiner*—Forester W. Isen
*Attorney, Agent, or Firm*—Spensley, Horn, Jubas & Lubitz

[57] ABSTRACT

An automatic performance device is of a type in which the automatic performance is executed in accordance with musical data read out successively. It comprises a fast feed stop control circuit for advancing the progress of the automatic performance when an actual key depression timing is faster than an ideal key depression timing indicated by the read out musical data and for temporarily stopping the progress when the former delays behind the latter. Comparison between the actual key depression timing and the ideal key depression timing is made by comparing the content of a counter counting the tempo pulses which decides the tempo of the automatic performance with note-length information included in the musical data. It further comprises a tempo control circuit for changing a period of the tempo pulses based on a tempo of a performance made by the actual key depression. The detection of the tempo of the performance made by the actual key depression is based on a count value of a counter counting the clock pulses whose period varies with the note-length information and presence or absence of the actual key depression. In order to prevent the period of the tempo pulses from being changed by only one great deviation of the actual key depression timing, the count value is latched at every key depression, the newest count values are kept, and the tempo detection may be made in accordance with the average value of the newest count values.

77 Claims, 11 Drawing Figures

AUTOMATIC PERFORMANCE DEVICE WITH TEMPO FOLLOW-UP FUNCTION

BACKGROUND OF THE INVENTION

This invention relates to an automatic performance device capable of adjusting the progress of automatic performance in response to the depression of keys by a performer.

Automatic performance devices in the prior art include those that automatically perform melody tones or other musical tones, automatically perform bass and chord tones, automatically perform arpeggio tones, and automatically perform rhythm tones on the basis of score data stored in a memory. Another automatic performance device in the prior art is in combination of some of the above devices. However, in all of these conventional automatic performance devices, automatic performance is carried out in the same tempo from start through end once it is initially set.

Accordingly, in an electronic musical instrument provided with such an automatic performance device, performance by depression of keys on the keyboards together with the automatic performance by the automatic performance device may cause such problem that key depression timing does not coincide with the progress of the automatic performance. Suppose that the key depression timing is faster than the progress of the automatic performance. In this case, if the next key is depressed in accordance with the length indicated by the next note on the music sheet (score), the above lead is maintained resulting again in time discrepancy between the manual and automatic performance in the next tone, and if the next key is depressed in coincidence with the timing of the automatic performance, the length of the tone produced becomes longer than what the corresponding note on the score represents since the tempo in the automatic performance is constant, i.e., independent of the key depression timing. In case that the key depression timing lags behind the tempo in the automatic performance, to the contrary, the equivalent lag remains if the next key depression timing is taken in accordance with the length of the next note, and the tone produced is shorter than what the corresponding note represents.

This independence of the automatic performance according to the prior art from the manual key depression timing may cause another problem. When a performer wishes to change the tempo during the performance, a time discrepancy between the key depression timing and the tempo of the automatic performance will inevitably occur. If the temp of automatic performance can be adjusted in response to the key depression timing, the discrepancy will be eliminated and the key depression timing becomes coincident with the tempo in automatic performance. In an automatic performance device of the prior art, the tempo is adjusted by operating a tempo adjusting knob of the device. However, the tempo adjustment in the conventional device is practically impossible during performance since it involves highly delicate manupilation of the tempo adjusting knob.

SUMMARY OF THE INVENTION

According to this invention, timing at which a musical tone is generated in automatic performance (automatic performance tone generation timing) is compared with timing at which a key is depressed in manual performance (key depression timing). As the result of this comparison, if the automatic performance tone generation timing is advanced or fast compared with the key depression timing, the speed of the automatic performance is increased or the timing is instantaneously advanced, and, if the key depression timing lags behind the automatic performance tone generation timing, the automatic performance is temporarily stopped so that the performance by the key depression and the automatic performance proceed at the same timing.

In addition, the tempo of the performance by the key depression is detected, and the tempo of the automatic performance is follow-up controlled based on the tempo thus detected.

The main object of this invention is to provide a new automatic performance device with tempo follow-up function which does not require tempo adjustmment by a performer during performance.

Another object of the invention is to provide an automatic performance device in which the progress of the automatic performance is automatically follow-up controlled in response to the key depression timing.

Still another object of the invention is to provide an automatic performance device which can automatically control the tempo of automatic performance so as to follow delicate changes in tempo in the manual performance when the performer manually plays a musical instrument while the device of this invention is in the automatic performance of melody tones, chords, rhythm tones, etc. by reading score data from the memory.

An embodiment of the invention will now be described in detail with reference to the attached drawings.

DESCRIPTION OF PREFERRED EMBODIMENTS

In this specification, the term automatic performance involves displaying a depresssed key or keys on the basis of readout information from the score data in addition to the above-mentioned automatic performance of melody tones or other musical tones, automatic performance of bass and chord tones, automatic performance of arpeggio tones and automatic performance of rhythm tones as well as automatic performance of tones in combination with some of these above tones.

Figure 1:
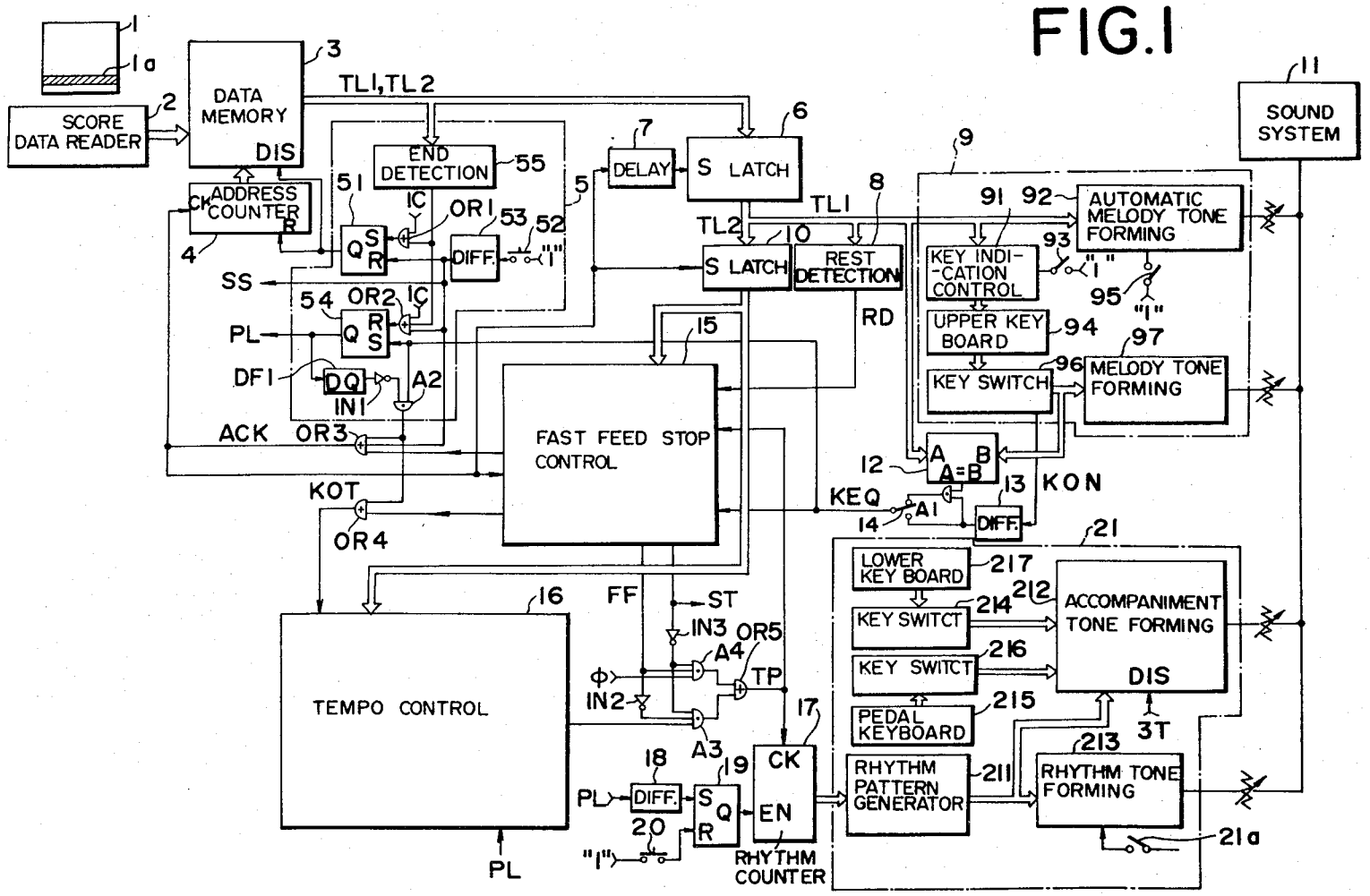
FIG. 1 is a block diagram of an embodiment of this invention wherein an electronic musical instrument is provided with automatic performance functions for melody tones, accompaniment tones and rhythm tones.

Referring to FIG. 1, an embodiment of the invention is applied to an electronic musical instrument provided with an automatic melody tone performance function for automatically performing melody tones, an automatic accompaniment tone performance function for automatically performing accompaniment tones such as chords and bass tones, and an automatic rhythm tone performance function for automatically performing rhythm section tones, these automatic performance functions being carried out based on the data read out from the recorded data of a magnetic tape 1*a* provided on a score 1 by means of a score data reader 2. In this embodiment, the automatic melody tone performance based on the reading of the score data is for practice purposes of melody performance. Therefore these melody tones are performed in a low sound volume which is subdued enough to indicate the key to be depressed subsequently. That is, in this embodiment the automatic melody tone performance is intended to generate melody tones always preceding by one tone so as to indicate the key to be depressed next.

The output of the score data reader 2 which reads the recorded data of the magnetic tape 1*a* provided on the score 1 is fed to a data memory 3, and a data format is selected corresponding to the data thus read. Table 1 shows an example of the data format.

TABLE 1:

| Data Format | | |
|---|---|---|
| D1: | Pitch data TL1, | Length data TL2 |
| D2: | . | . |
| | . | . |
| | . | . |
| Dn-1: | Pitch data TL1 | Length data TL2 |
| Dn: | End data | |

As seen in Table 1, each data Di (i=1, . . . , n) consists of a pitch data TL1 and a length data TL2. The pitch data TL1 consists, for example, of a 7-bit data made up with a 4-bit note code NC and a 3-bit octave code OC, while the length data consists, for example, of an 8-bit data. Table 2 shows an example of the length data.

TABLE 2:

| | Length data | | | | | | | | |
|---|---|---|---|---|---|---|---|---|---|
| Note | Note length (binary) | | | | | | | | Decimal representation |
| Demisemiquaver | 0 | 0 | 0 | 0 | 0 | 1 | 1 | 0 | 6 |
| Semiquaver | 0 | 0 | 0 | 0 | 1 | 1 | 0 | 0 | 12 |
| Quaver | 0 | 0 | 0 | 1 | 1 | 0 | 0 | 0 | 24 |
| Crotchet | 0 | 0 | 1 | 1 | 0 | 0 | 0 | 0 | 48 |
| Minim | 0 | 1 | 1 | 0 | 0 | 0 | 0 | 0 | 96 |
| Whole note | 1 | 1 | 0 | 0 | 0 | 0 | 0 | 0 | 192 |

A rest is expressed by setting all bits of the pitch data to "0", while the end data Dn indicating the end of the data is represented by setting all bits of the pitch data TL1 and the note data TL2 to "1".

Each data Di is read from the data memory 3 by an address counter 4. The address counter 4 is reset by the output of a flip-flop 51 of a start-stop control circuit 5 upon power input. That is, an initial clear signal IC produced upon power input is being fed via an OR1 to a set terminal S of the flip-flop 51 in the start-stop control circuit 5, which sets the flip-flop 51, and initial-clears the address counter 4. In the meantime, the output of the flip-flop 51 in the start-stop control circuit 5 is being fed to a disable terminal DIS of the data memory 3, thus making the data memory 3 nonoperative.

Subsequently, when a start-set switch 52 of the start-stop control circuit 5 is turned on, the output of this start-set switch 52 is differentiated by a differentiation circuit 53, then is fed to a reset terminal R of the flip-flop 51, and resets the flip-flop 51. As a result, the address counter 4 is released from the reset state, and the data memory 3 becomes ready to operate. The differentiated output (a single pulse) of the differentiation circuit 53 is applied to the reset terminal R of a flip-flop 54 through an OR circuit OR2, and sends out a start-set signal SS by resetting the flip-flop 54. The output Q of the flip-flop 54 is used as a play signal PL as mentioned later. In this case, a start-set signal SS (a single pulse) is produced, while the play signal PL remains "0". The output of the differentiation circuit 53 is applied to a clock terminal CK of the counter 4 via the OR circuit OR3 as an address clock signal ACK, causes the address counter 4 to advance one step, and further causes the first data D1, i.e., a pitch data TL1 and a length data TL2 with respect to the first sound to be read from the data memory 3. The pitch data TL1 and the length data TL2 read from the data memory 3 are fed to a latch circuit 6. The latch circuit 6, to a strobe terminal of which the output of the OR circuit OR3 (address clock signal ACK) mentioned above is being applied through a delay circuit 7, latches the pitch data TL1 and the length data TL2 with respect to the first sound by the output of the delay circuit 7. The pitch data TL1 thus latched by the latch circuit 6 is fed to a rest detecting circuit 8, a key indication control circuit 91 of a melody tone forming section 9, and an automatic melody tone forming circuit 92, while the length data TL2 is applied to a latch circuit 10. However, since the latch circuit 10 has already received the output of the OR circuit OR3 at its strobe terminal directly without delay, the length data TL2 with respect to the first sound is not latched. The rest detecting circuit 8 is for detecting rests, and detects rests by utilizing the fact that a rest is indicated by setting all bits of the pitch data to "0" as mentioned before, and produces a rest detection signal RD upon detection of a rest.

The key indication control circuit 91 of the melody tone forming section 9 is for controlling the indication of the key corresponding to the pitch data TL1 applied thereto, and becomes ready to operate when a key indication select switch 93 is turned on, and sends out a key indication signal to the upper keyboard 94 to indicate the key corresponding to the applied pitch data TL1. In the upper keyboard 94, indicating lamps are arranged so as to correspond to each key, respectively (detail is not shown), and a corresponding lamp lights according to the key indication signal from the key indication control circuit 91. When the key indication select switch 93 is OFF, the key indication control circuit 91 becomes nonoperative, and no key indication is performed in the upper keyboard 94.

The automatic melody tone forming circuit 92 is for forming a melody tone corresponding to the pitch data TL1 applied thereto. The automatic melody tone forming circuit 92 becomes ready to operate as a melody tone automatic performance select switch 95 is turned on, forms a musical tone signal corresponding to the melody tone indicated by the applied pitch, and applies the tone signal to a sound system 11 to produce the indicated melody tone. When the melody tone automatic performance select switch 95 is OFF, the melody tone by the automatic performance is not produced because the automatic performance melody tone forming circuit 92 becomes nonoperative.

That is, firstly, the key of the first sound (the key to be firstly depressed) in the performance is indicated by the indication lamp corresponding to said key providing that the key indication select switch 93 is ON, and then the first tone (the musical tone to be firstly produced) in the performance is generated providing that the melody tone automatic performance select switch 95 is ON. The musical tone produced by the automatic melody tone forming circuit 92 is a musical tone to be produced manually by a performer, therefore, normally the melody tone automatic performance select switch 95 is being turned off or a melody tone volume control VR1 adjusted to a low volume. The operation will now be described assuming that the melody tone automatic performance select switch 95 is set to OFF.

In this state, when the key in the upper keyboard 94 whose indication lamp is ON is depressed, this depressed key is detected by a key switch circuit 96, and a key code KC (4-bit note code NC plus 3-bit octave code OC) indicating that said depressed key is delivered from the key switch circuit 96. The key code KC is fed to a melody tone forming circuit 97. The melody tone forming circuit 97 forms a musical tone signal corresponding to the melody tone indicated by the key code KC, applies it to the sound system 11 via a tone volume control VR2 to produce the indicated melody tone.

The key code KC delivered from the key switch circuit 96 is applied to a B input of a comparator 12. The comparator 12 receives the pitch data TL1 of the data latched by the latch 6 at its A input. When the pitch data TL1 (indicating the tone to be depressed) to be applied to the A input and the key code KC (indicating the tone depressed) coincide with each other (A=B), a coincidence signal is output. The coincidence signal is fed to an AND circuit A1. The AND circuit A1 has another input terminal to which a signal resulted from the differentiation via the differentiation circuit 13 of a key-on signal KON ("1" when the key is depressed and "0" when the key is released) delivered from the key switch circuit 96 has already been fed, and outputs a pulse (key depression coincidence signal) KEQ synchronized with the key depression under the condition that the key whose indication lamp is ON is depressed. The key depression coincidence signal KEQ is fed to a fast feed stop control circuit 15 and is also fed to a set terminal S of the flip-flop 54 and an AND circuit A2 via a select switch 14. The select switch 14 is for selecting whether or not a mistouch in the key depression is removed. When the select switch 14 is in the position as shown in FIG. 1, no key depression coincidence signal KEQ is produced if the key depression is a mistouch, i.e. if the key in the upper keyboard whose indication lamp is ON does not coincide with the depressed key. On the other hand, when the select switch 14 is switched in the other position, a key depression coincidence signal KEQ is produced via the select switch 14 even if the key depression is a mistouch. The operation will now be described assuming that the select switch 14 is in the position as shown in FIG. 1.

The quick feed stop control circuit 15 does not operate even if the first key depression coincidence signal KEQ is fed. However, since the flip-flop 54 of the start-stop control circuit 5 has been reset, and the AND circuit A2 to which a play signal PL delivered from the flip-flop 54 is applied through a delay flip-flop DF1 and an inverter IN1 is ready to operate, the key depression coincidence signal KEQ is applied to the OR circuits, OR3 and OR4. Accordingly, an address clock signal ACK is outputted from the output of the OR circuit OR3 thereby causing the address counter to advance one step, while the output of the OR circuit OR4 is fed to a tempo control circuit 16 as a key-on timing signal KOT. This key-on timing signal KOT is for controlling a tempo pulse TP produced at the tempo control circuit 16 as mentioned later.

The flip-flop 54 is set by the first key depression coincidence signal KEQ, and the play signal PL rises to "1". Accordingly, the signal to be fed to the AND circuit A2 through the delay flip-flop DF1 and the inverter IN1 becomes "0" one clock time after the rise of the play signal PL, the AND circuit A2 becomes nonoperative, and the subsequent passage of the key depression coincidence signal KEQ in the AND circuit A2 is inhibited.

Since the output of the OR circuit OR3 is fed to the strobe terminal of the latch circuit 10, the length data TL2 wih respect to the first tone latched by the latch circuit 6 is latched by the latch circuit 10.

As the address counter 4 is advanced one step by the first key depression coincidence signal KEQ, the data D2 with respect to the second tone (pitch data TL1 and length data TL2) is read from the data memory 3, and this data D2 is latched at the latch circuit 6 by the output of the OR circuit OR3 delayed by the delay circuit 7. The pitch data TL1 of the data latched by the latch circuit 6 is fed to the rest detecting circuit and the melody tone forming circuit 9, and performs the rest detection and ON-OFF control of the indication lamp provided on the key of the tone to be produced next. These controls are conducted in the same manner as in those described previously.

A play signal PL produced from the start-stop control circuit 5 is fed to the tempo control circuit 16. The tempo control circuit 16 forms a tempo pulse TP which determines the tempo of the automatic performance in this embodiment, and the initial tempo pulse set in advance is outputted providing that a play signal PL is produced in the initial state. (Detailed circuit composition is explained later). The tempo pulse TP is fed to the clock terminal CK of a rhythm counter 17 through the AND circuit A3 and the OR circuit OR5.

The rhythm counter 17 counts tempo pulses TP, and controls the progress of the automatic accompaniment tone performance mentioned below. Said rhythm counter 17 is so constructed as to be set initially by the output of a flip-flop 19 which is set by the above mentioned play signal PL differentiated at a differentiation circuit 18. A stop switch 20 is for stopping the automatic accompaniment tone performance, and the flip-flop 19 is reset as the stop switch 20 is turned on, thereby making the rhythm counter 17 nonoperative.

The output of the rhythm counter 17 is fed to a rhythm pattern generator circuit 211 of an accompaniment tone forming section 21. The rhythm pattern generator circuit 211 includes a ROM which stores the predetermined performance pattern by taking the output of the rhythm counter 17 as the address signal of the ROM, and sequentially generates pattern pulse based on said performance pattern corresponding to the output of the rhythm counter 17. Pattern pulses generated by the rhythm pattern generator circuit 211 are fed to an accompaniment tone forming circuit 212 and a rhythm tone forming circuit 213.

The accompaniment tone forming circuit 212 detects a depressed key in a lower keyboard 217, detects the output of a key switch circuit 214 and the key depressed at a pedal keyboard 215, receives the output of a key switch circuit 216 which outputs the key information about said key, and forms musical tone signals corresponding to accompaniment tones, such as chord tones, bass tones, and arpeggio tones, based on the key information and the pattern pulses sequentially outputted from the rhythm pattern generator circuit 211 to apply these signals to the sound system 11 via a tone volume control VR3.

The rhythm tone forming circuit 213, which becomes in the enable state when a select switch 21*a* turns ON, is for opening and closing multiple rhythm tone sources based on the pattern pulses generated at the rhythm pattern generator circuit 211 to form musical tone signals corresponding to the rhythm tones, which is fed to the sound system 11 via a tone volume VR4 and converted into rhythm tones by the sound system 11. Therefore, when the select switch 21*a* is set to ON, rhythm tones are automatically generated in synchronism with the manual performance by the upper keyboard 94 and the automatic rhythm performance stops upon the depression of the stop switch 20.

Since various known devices may be used for forming accompaniment tones, such as chord tones, base tones, and arpeggio tones, based on the key information from the lower keyboard and the pedal keyboard as well as on the pattern pulses, and for forming rhythm tones based on the pattern pulses, detailed structural description thereon is omitted.

Musical tone signals indicating the accompaniment tones thus formed at the accompaniment tone forming section 21 are fed to the sound system 11, and musical tones are produced.

When a key in the upper keyboard 94 whose indication lamp has lit is depressed under the condition that the lit indication lamp corresponds to the second tone and the automatic accompaniment tone performance has started, a coincidence signal is produced at the comparator 12, the AND circuit A1 becomes ready to operate, and the key depression coincidence signal KEQ is fed to the fast feed stop control circuit 15 via the select switch 14.

The fast feed stop control circuit 15 judges whether the key depression timing in the upper keyboard 94 is leading or lagging based on the length data TL2 latched by the latch circuit 10, outputs a fast feed signal FF when said key depression timing is fast, and outputs a stop signal ST when said timing is delayed. This fast feed signal FF is fed to an AND circuit A4, and is also fed to the AND circuit A3 after being inverted at the inverter IN2. As a result, the AND circuit A3 becomes nonoperative, the AND circuit A4 becomes ready to operate, and a high speed clock pulse $\phi$ is outputted as a tempo pulse TP through the AND circuit A4 and the OR circuit OR5. Accordingly, the automatic performance is advanced rapidly so that the progress of the automatic performance and the key depression timing coincide with each other. Further, the stop signal ST is applied to the AND circuits A3 and A4 after being inverted by inverter IN3. As a result, these AND circuits A3 and A4 become nonoperatable, whereby tempo pulses outputted from the OR circuit OR5 is halted, thus the progress of automatic performance is halted. As will be apparent from description to be made later, this halt of automatic performance lasts until the next key depression is made and therefore enables the progress of the automatic performance to coincide with the key depression timing.

Figure 2:
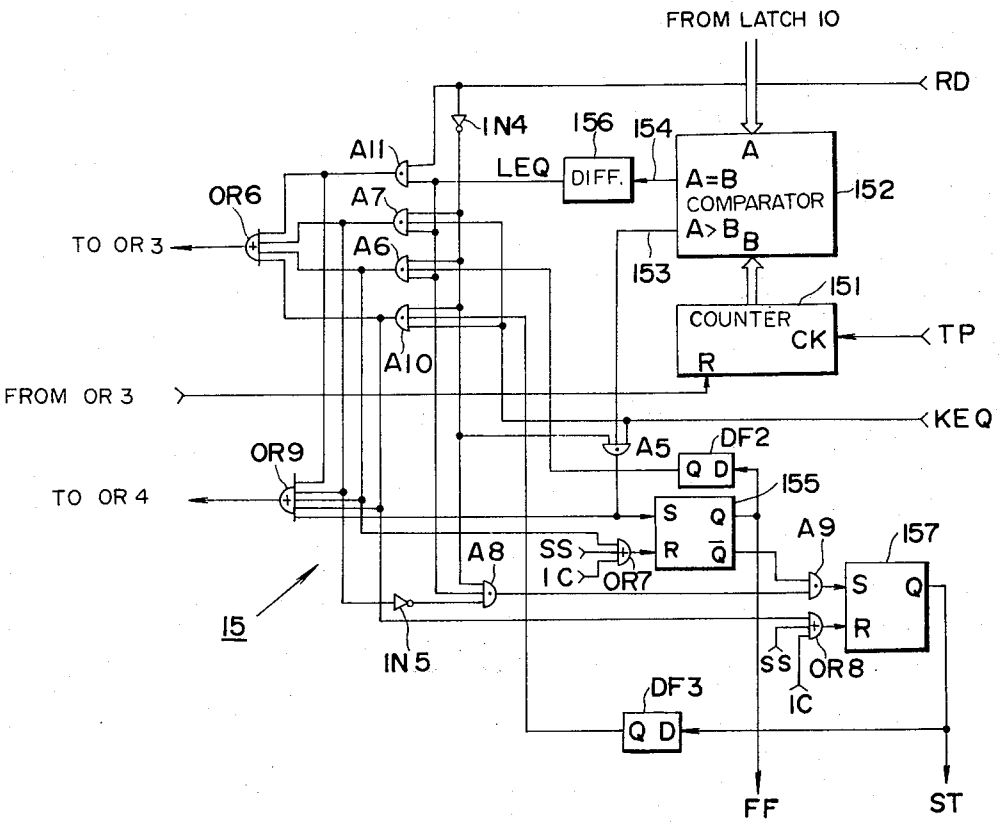
FIG. 2 is a preferred block diagram of the fast feed stop control circuit in detail.

Preferred configuration of the said fast feed stop control circuit 15 is shown in FIG. 2 in detail.

In FIG. 2, since a counter 151 has received the output of the OR circuit OR3 (FIG. 1) at its reset terminal R and a tempo pulse TP at its clock terminal CK, the counter 151 is reset synchronized with the output of the OR circuit OR3 (the key depression timing of the first tone in the above case), and counts tempo pulses subsequently.

In a comparator 152, the output of the counter 151 is fed to its B input, and the output of the latch circuit 10 (FIG. 1) is fed to its B input. As apparent from the above description, the information latched by the latch circuit 10 is the length data TL2 with respect to the first tone. The comparator 152 compares the length data TL2 fed to the A input thereof with the count value of the counter 151, outputs a signal "1" to a line 153 if $A>B$, and outputs a signal "1" to a line 154 if $A=B$.

The key depression timing with respect to the second tone can be fast, coincide or be delayed with respect to the length data TL2. The operation in each case is described below.

(1) When the depression timing is fast

When the depression timing is fast with respect to the length data TL2 latched at the latch circuit 10, a key depression coincidence signal KEQ is produced before the count value of the counter 151 reaches said length data TL2. Accordingly, a signal "1" is outputted to the line 153 from the comparator 152 at the time when the key depression coincidence signal KEQ is produced, the output of the AND circuit A5 which operates according to the AND condition of the key depression coincidence signal KEQ, the signal of line 153 and the signal inverted rest detecting signal RD from the rest detecting circuit 8 (FIG. 1) (in this case, the rest detecting signal RD is assumed to be "0") at the inverter IN4 becomes "1", and a flip-flop 155 is caused to set since the output of the AND circuit A5 is fed to the set terminal S of the flip-flop 155. The output Q of the flip-flop 155 is sent out as a fast feed signal FF, makes the AND circuit A4 (FIG. 1) ready to operate as mentioned previously, and advances the automatic performance rapidly.

The output of the flip-flop 155 is also applied to an AND circuit A6 through a delay flip-flop DF2. To the other inputs of the AND circuit A6, the output of the inverter IN4 (inverted rest detection signal RD) and the length equal signal LEQ resulted from the differentiation of the signal of the line 154 outputted from the comparator 152 through a differentiation circuit 156 are applied. Accordingly, the relation $A=B$ is established at the comparator 152, the AND condition is established at the time when a length equal signal LEQ is generated, and consequently the AND circuit 6 outputs a signal "1" (pulse signal). This signal from the AND circuit 6 is fed to the OR circuit OR3 (FIG. 1) via an OR circuit OR6 and is applied to the clock terminal CK of the address counter 4, causing the address counter 4 to advance one step. In this case, since the counter 151 is advanced by a high speed clock $\phi$, the content of the counter reaches the length data TL2 instantaneously, and the relation $A=B$ is established at the comparator 152. Accordingly, the AND condition is established at the AND circuit A6 almost at the same time with the generation of key depression coincidence signal KEQ, and almost at the same time with the generation of the key depression coincidence signal, the address counter 4 is advanced one step further. To a reset terminal R of the flip-flop 155, which outputs a fast feed signal FF, are applied the output of the AND circuit A6, and the output of the OR circuit OR7, which takes the OR condition of the output of the AND circuit A6, the start set signal SS and the initial clear signal IC, and in this case the flip-flop 155 is reset by the output of the AND circuit A6, and the fast feed signal FF becomes "0".

That is, when the key depression timing is fast with respect to the length data TL2 latched at the latch circuit 10, the automatic performance is rapidly advanced until the count value of the counter 151 and the length data TL2 coincide with each other, hence the progress of the automatic performance is brought to coincide with the key depression timing.

(2) When the key depression timing and the length data TL2 coincide with each other When the key depression timing and the length data TL2 coincide with each other, the relation A=B is established at the comparator 152 simultaneously with the generation of the key depression coincidence signal KEQ, and a signal "1" occurs at the line 154. This signal "1" is differentiated at a differentiation circuit 156, and is applied to the AND circuit A7 as a length equal signal LEQ. To the other inputs of the AND circuit A7 are applied the output of the inverter IN4 which is an inverted rest detection signal RD, and the key depression coincidence signal KEQ. Accordingly, the AND condition is established at the AND circuit A7, and a signal "1" (a pulse signal) is fed to the OR circuit OR3 via the OR circuit OR6. As a result, an address clock signal ACK is produced at the output of the OR circuit OR3, and the address counter 4 is advanced one step further by the address clock signal ACK. That is, when the key depression timing and the length data TL2 latched at the latch circuit 10 coincide with each other, no control is made against the tempo pulse, and the address counter 4 is advanced to the next step.

(3) When the key depression timing is delayed

When the key depression timing lags behind the length data TL2 latched at the latch circuit 10, or when the key depression is delayed from the correct timing due to mistouch, the count value of the counter 151 reaches each length data TL2 before the generation of a key depression coincidence signal KEQ, the relation A=B is established at the comparator 152, and a length equal signal LEQ is generated at the differentiation circuit 156. This length equal signal LEQ is applied to an AND circuit A8. To the other inputs of the AND circuit are applied the output signal of the inverter IN4 and the output signal of an inverter IN5 which is an inverted output of the AND circuit A7. In this case, since the rest detection signal RD is "0" and the output of the AND circuit A7 is "0", the AND condition of the AND circuit A8 is established, and a signal "1" is output. The output of this AND circuit A8 is applied to the set terminal S of a flip-flop 157 through an AND circuit A9, to the other input of which an inversed output Q ("1" in this case) of the flip-flop 155 is applied. As a result, the flip-flop 157 is set. The output Q of this flip-flop 157 is sent out as a stop signal ST, makes the AND circuit A3 and A4 (FIG. 1) nonoperative, thus causing the automatic performance to be interrupted as already mentioned.

The output Q of the flip-flop 157 is also fed to an AND circuit A10 through a delay flip-flop DF3. To the other input of the AND circuit A10 are applied the output of the inverter IN4 and a key depression coincidence signal KEQ. Accordingly, the AND circuit A10 where the AND condition becomes established at the timing of the key depression coincidence signal KEQ, applies a signal "1" (a pulse signal) to the OR circuit OR3 (FIG. 1) through the OR circuit OR6, and an address clock signal ACK is produced, causing the address counter 4 to advance one step further. To a reset terminal R of the flip-flop 156 which outputs a stop signal ST is applied the output of the OR circuit OR8 which takes the OR condition of the output of the AND circuit A10, the start-set signal SS and the initial clear signal IC. In this case, the flip-flop 157 is reset by the output of the AND circuit A10, and the stop signal ST becomes "0".

That is, when the key depression timing lags behind the length data TL2 latched at the latch circuit 10, the automatic performance is interrupted until the key is depressed after the key depression timing and said length data TL2 coincided with each other, thus bringing the progress of the automatic performance to coincide with the key depression timing.

The above description has been made under the condition that the rest detection signal RD outputted from the rest detection circuit 8 is "0", while when the rest detection signal RD is assumed to be "1", i.e., the tone to be depressed next is a rest, the key is not depressed at the timing of the length data TL2. In this case, an AND circuit A11 which takes the AND condition of the rest detection signal RD and the length equal signal LEQ outputs a signal "1" (pulse signal) at the timing when the AND circuit A11 generates a length equal signal LEQ, i.e., when the count value of the counter 151 coincides with the length data TL2 latched at the latch circuit 10 as found by the comparison at the comparator 152. Said signal is fed to the OR circuit OR3 through the OR circuit OR6, thereby producing an address clock signal ACK and advancing the address counter one step further.

The output of an OR circuit OR9 is fed to the tempo control circuit 16 through the OR circuit OR4 (FIG. 1) as a key-on timing signal KOT based on the OR condition of the outputs of the AND circuits A5, A6, A7, A10, and A11.

Although the above description has been made based on the relation between the first and the second tones, similar control is performed with respect to the third tone, the fourth tone, etc.

When the automatic performance ends and the end data in which all bits of the pitch data TL1 and the length data TL2 are "1" is read out from the data memory 3, this end data is detected at an end detection circuit 55 of the start-stop control circuit 5. The detected output of the end detection circuit 55 is applied to the set terminal S of the flip-flop 51 through the OR circuit OR1 and to the reset terminal R of the flip-flop 54 through the OR circuit OR2, thereby resettng the flip-flops 51 and 54. As a result, the data memory 3 becomes nonoperative, the address counter 4 is reset, and the play signal becomes "0".

The above operation is described with reference to the timing chart of FIG. 3 as follows. In this case, the automatic performance is performed according to a score as shown in FIG. 3(*a*), in which the key depression timing of the second tone is fast, the key depression timing of the fourth tone (rest is counted as a tone) is delayed, and the key depression timing of the fifth tone coincides.

Figure 3:
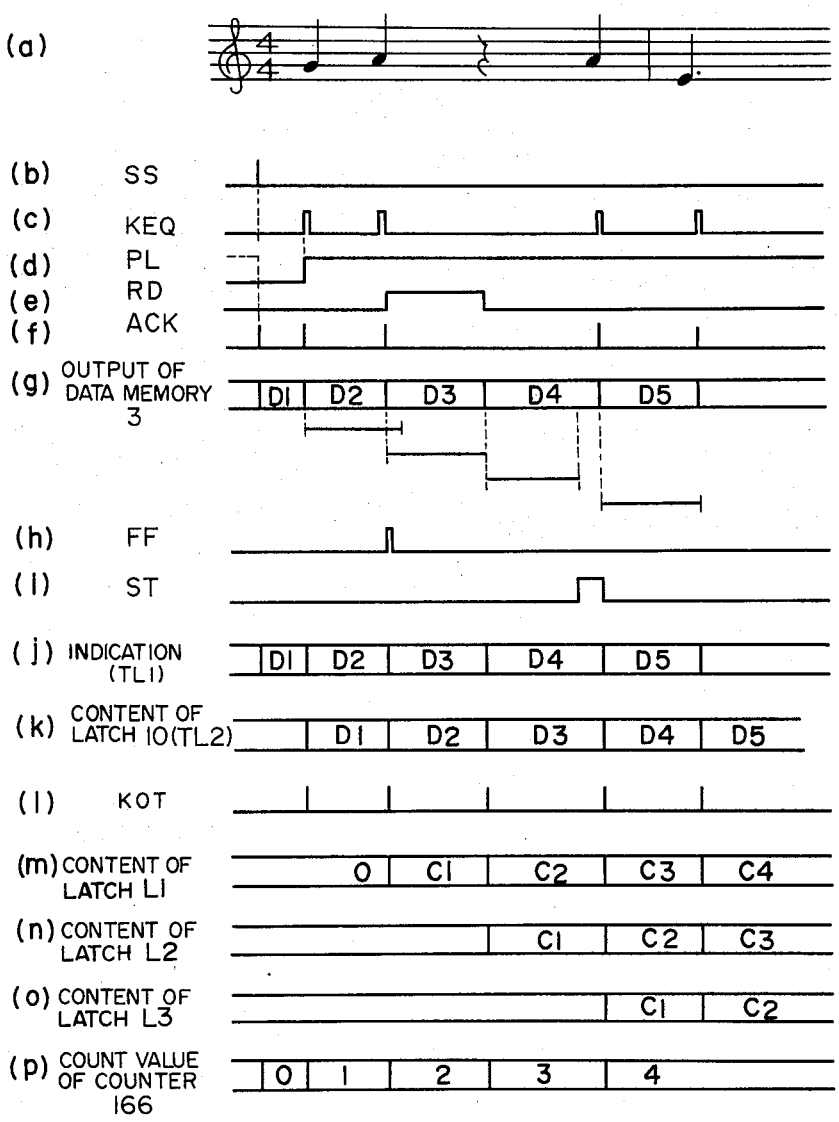
FIG. 3 is a timing chart showing three cases, i.e., the key depression timing is fast, delayed and coincident with respect to the automatic performance.

First, when the start set switch 52 of the start-stop control circuit 5 is turned on, a start-set signal SS is produced as shown in FIG. 3(*b*). As a result, an address clock signal ACK (FIG. 3(*f*)) is produced, the address counter 4 advances one step, and the data D1 (FIG. 3(*g*)) concerning the first tone is read from the data memory 3. The data D1 is latched at the latch circuit 6, and the key of the upper keyboard 94 in the melody tone forming section 9 which is to be depressed next is indicated by an indication lamp based on the pitch data TL1 of the data thus latched. FIG. 3(*j*) shows the data regarding this indication.

Then, when the key of the upper keyboard 94, whose indication lamp is lit (namely the key specified by the pitch data TL1 of the D1 is depressed), a key depression coincidence signal KEQ (FIG. 3(*c*)) is produced, a play signal PL (FIG. 3(*d*)) rises as a result, and an address clock signal ACK is produced at the same time. By this address clock signal ACK the length data TL2 of data D1 is latched at the latch circuit 10. (FIG. 3(*k*)). The address counter 4 is advanced one step by the address clock signal ACK, and data D2 is read from the data memory 3. As the data D2 is read from the data memory 3, the content of the latch circuit 6 changes to data D2, and the indication lamp at the upper keyboard 94 of the melody tone forming section 9 indicates the key specified by the pitch data TL1 of data D2.

When, in this state, the key which is indicated by the indication lamp of the upper keyboard 94 is depressed earlier than the note length specified by the length data TL2 of data D1, a key depression coincidence signal KEQ is produced in coincidence with this depression timing, but since the count value of the counter 151 (FIG. 2) of the fast feed stop control circuit 15 does not reach the length data TL2 of data D1, the AND condition of the AND circuit A5 (FIG. 2) of the fast feed stop control circuit 15 is established, the flip-flop 155 is set accordingly, and a fast feed signal FF is produced (FIG. 3(*h*)). As a result, the AND circuit A4 becomes ready to operate, the counter 151 is caused to count up rapidly by a clock pulse $\phi$, the relation A=B is established at the comparator circuit 152, and a length equal signal LEQ is produced. As a length equal signal LEQ is produced, the AND condition of the AND circuit A6 (FIG. 3) is established, and an address clock signal ACK is produced. By this address clock signal ACK, the content of the latch circuit 10 is rewritten to the length data TL2 of data D2, and data D3 is read from the data memory 3. The output of the AND circuit A6 resets the flip-flop 155, and the fast feed signal FF stops. That is, when the key depression timing is faster than the timing specified by the length data TL2, the tempo pulse TP is switched to the high speed pulse $\phi$ to speed up the automatic performance, hence bringing the pace of the automatic performance to coincide with the key depression timing.

As the result that data D3 is read from the data memory 3, the content of the latch circuit 6 changes from data D2 to data D3. In this case, since data D3 is a data indicating a rest, it is detected by the rest detection circuit 8, and a rest detection signal RD is outputted from the rest detection circuit 8 as shown in FIG. 3(*e*). As a result, the AND condition of the AND circuit A11 is established at the timing when the content of the counter 151 in the fast feed stop control circuit 15 reaches the length data TL2 of data D2 latched by the latch circuit 10, and an address clock signal ACK is produced.

As the address clock signal ACK is produced, the content of the latch circuit 10 is rewritten to the length data of data D3 latched at the latch circuit 6, and the data read from the memory 3 changes from data D3 to data D4. The content of the latch circuit 6 is rewritten to data D4, and the key specified by the pitch data TL1 of data D4 which is located at the upper keyboard 94 of the melody tone forming section 9 is indicated by the indication lamp.

In the case when the key depression timing lags behind the timing specified by the length data of data D3, the relation A=B is established at the comparator 152 of the fast feed stop control circuit 15 before the generation of the key depression timing, the AND condition is established at the AND circuit A8 at this time, the flip-flop 156 is set, and a stop signal ST is generated (FIG. 3(*i*)). Upon the generation of the stop signal ST, the automatic performance is stopped in the manner as already described. If, in this state, a key depression coincidence signal KEQ is generated, the AND condition of the AND circuit A7 in the fast feed stop control circuit 15 is established and an address clock signal ACK is generated. By this address clock signal ACK the length data TL1 of data D4 is transferred to the latch circuit 6, the address counter 4 is advanced one step, and data D5 is read from the data memory 3. By the output of the AND circuit A7, the flip-flop 157 of the fast feed stop circuit 15 turns reset, and the stop signal ST becomes "0". As a result, the stop state of the automatic performance is released. That is, when the key depression timing lags behind the timing specified by the length data TL2, the automatic performance is interrupted until the key is depressed, and the pace of the automatic performance is caused to coincide with the key depressing timing.

As data D5 is read from the data memory 3, the latch data of the latch circuit 6 is rewritten to said data D5, and the key of the upper keyboard 94 in the melody tone forming section 9 which is specified by the pitch data TL1 of data D5 is indicated by the indication lamp. As the key indicated by the indication lamp is depressed in coincidence with the timing specified by the length data of data D4 latched at the latch circuit 10, the AND condition of the AND circuit A10 in the fast feed stop control circuit 15 is established, and an address clock signal ACK is generated. That is, when the key depression timing and the timing specified by the length data TL2 coincide with each other, the fast feed stop control circuit 15 exerts no control against the progress of the automatic performance.

The tempo control circuit 16 controls the tempo pulse TP according to the key depression tempo. That is, when the key depression tempo becomes fast, the period of the tempo pulse is shortened accordingly, while as the key depression tempo is slackened, the period of the key depression tempo is lengthened accordingly. This control is performed according to the length data TL2 of each tone latched at the latch circuit 10 and the key-on timing signal KOT outputted from the OR circuit OR4.

Figure 4:
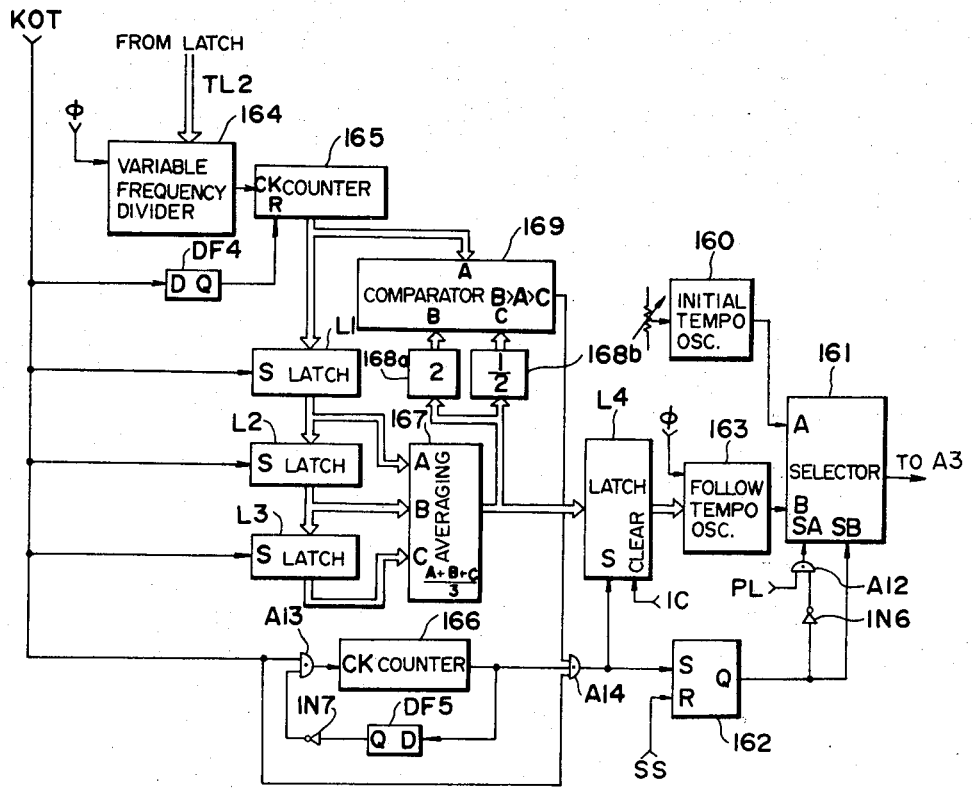
FIG. 4 is a preferred block diagram of the tempo control circuit in detail.

FIG. 4 shows a block diagram of said tempo control circuit 16 in detail. As a start set-signal SS is generated by the start-stop control circuit 5 (FIG. 1) and than a play signal PL is generated, an initial tempo pulse set at an initial tempo oscillator 160 is outputted. The initial tempo pulse of the preset frequency outputted from the initial tempo oscillator 160 is applied to the A input of a selector 161, while the start-set signal SS outputted from the start-stop circuit 5 is fed to a reset terminal R of a flip-flop 162, thus causing the flip-flop 162 to be reset. The output of the flip-flop 162 is inverted at the inverter IN6, and is fed to the A input select terminal SA of the selector 161 through the AND circuit A12 which is made ready to operate by the play signal PL. Accordingly, upon the play signal PL becoming "1", the selector 161 first selects the initial tempo pulse outputted from the initial tempo oscillator 160 and outputs the selected pulse.

The initial tempo pulse is used under the initial condition until a tempo pulse based on the key depression tempo becomes ready to be formed (up to the depression of the fourth tone in this case). As the specified condition is established, the tempo pulse is generated at a follow tempo oscillator 163 based on the key depression tempo.

The length data TL2 relative to the first tone which is latched at the latch circuit 10 by the address clock signal ACK outputted from the OR circuit OR3 (FIG. 1) as the first tone is depressed is fed to a variable frequency divider 164. The variable frequency divider 164 divides the clock pulse $\phi$ according to said length data TL2, and outputs a pulse signal of the period corresponding to the length data TL2, i.e., a pulse signal of a high frequency when the length data TL2 is small and a pulse signal of a low frequency when the length data TL2 is large. The output pulses of the variable frequency divider 164 are counted by a counter 165. The reason for forming the pulse signal of a period corresponding to the length data TL2 at the variable frequency divider 164 is to make the count value of a counter 165 which counts said pulse signals a value independent of the length data. That is, the counter 165 receives a key-on timing signal KOT delayed at a delay flip-flop DF4 at its reset terminal R, and the count value of said counter is reset each time when the key-on timing signal is generated, but it is so constructed that the count value of the counter 165 at the time of reset is constant regardless of the length data if the key depression tempo is constant.

The value corresponding to the key depression tempo which is counted by said counter 165 is sequentially transferred to latch circuits L1, L2, and L3 by the key-on timing signal KOT.

The key-on timing signals KOT are, on the other hand, fed to the clock terminal CK of a counter 166 through an AND circuit A13, and are sequentially counted. The counter 166 comprises a 3-bit shift register and outputs a carry signal as the count value becomes "4". This carry signal is also fed to an AND circuit A13 through a delay flip-flop DF5 and an inverter IN7, and inhibits subsequent operation of the AND circuit A13.

The operations of the latch circuits L1, L2, and L3 as well as the operation of the counter 166 are described with reference to the timing chart of FIG. 3 as follows. In FIG. 3, key-on timing signals KOT are generated synchronized with the key depression timing as shown in FIG. 3(*l*). It should be noted here that though the key is not depressed for the rest, a key-on timing signal KOT is generated at the start timing of that rest. That is, a similar evaluation is also given to the rest as the key depression, and a key-on timing signal KOT is generated. While the length data TL2 relative to the first tone is latched at the latch circuit 10, the counter 165 counts pulse signals of the period correspond to said length data TL2. The count value C1 is transferred to the latch circuit L1 by the key-on timing signal KOT relative to the second tone (FIG. 3(*m*)). Similarly, while the length data TL2 relative to the second tone is latched at the latch circuit 10, the counter 165 counts pulse signals of the period corresponding to the length data TL2. This count value C2 is transferred to the latch circuit L1 by the key-on timing signal KOT, and similarly the content C1 of the latch circuit L1 is transferred to the latch circuit L2 (FIG. 3(*n*)). In the same way, as a key-on timing signal KOT relative to the fourth tone is generated, the content of the latch circuit L1 becomes the count value C1 (FIG. 3(*o*)), the content of the latch circuit L2 becomes the count value C2, and the content of the latch circuit L3 becomes the count value C3.

The counter 166 counts up according to the key-on timing signals KOT, and stops counting when the count value becomes "4".

The outputs of the latch circuits L1, L2 and L3 which have latched values relative to the key depression are applied to the latch circuit L4 after being averaged at an averaging circuit 167. The output of the averaging circuit 167 is doubled and halved at a double circuit 168*a* and a halving circuit 168*b* respectively, and the double and halved outputs are fed to the B and C inputs of a comparator circuit 169 respectively. To the A input of the comparator 169 is applied the output of the counter 165. If the value applied to the A input is less than the value applied to the B input but larger than the value applied to the C input, the comparator 169 outputs a signal "1". This signal "1" is fed to an AND circuit A14. To other input terminals of the AND circuit A14 are applied the output of the above-mentioned counter 166 and the key-on timing signal KOT. Accordingly, the AND condition of the AND circuit A14 is established at the timing when the key-on timing signal KOT is applied provided that the count value of the counter 165 is between the double and a half the value of the output of the averaging circuit 167 and the count value of the counter 166 has reached "4", a signal "1" is outputted. The output of this AND circuit A14 is fed to a strobe terminal S of the latch circuit L4, and is also applied to the set terminal S of the flip-flop 162. That is, the latch circuit L4 latches the output of the averaging circuit 167 at the timing of the key-on signal KOT provided that:

(1) Latch circuits L1, L2 and L3 are filled with data, and (2) The count value of the counter 165 does not differ greatly from the output value of the averaging circuit 167.

The value latched at the latch circuit L4 is fed to the follow tempo oscillator 163. The follow tempo oscillator comprises a variable frequency divider, and generates follow tempo pulses varying according to the key depression tempo dividing the frequency of clock pulses $\phi$ corresponding to the output of the latch circuit L4. These follow tempo pulses are applied to the B input of the selector 161.

As the result of the application of the output of the AND circuit A14 to the set terminal S, the flip-flop 162 is set, and the output Q of this flip-flop 162 is applied to a B input select terminal SB of the selector 161. Thereby the selector 161 selects a follow tempo pulse fed to the input B, and outputs said pulse as a subsequent tempo pulse TP.

The latch circuit L4 does not latch the output of the averaging circuit 167 when the count value of the counter 165 greatly differs from the output value of the averaging circuit 166 so as to prevent the frequency of the tempo pulse from being changed by a single tone whose tempo is greatly deviated.

Figure 5:
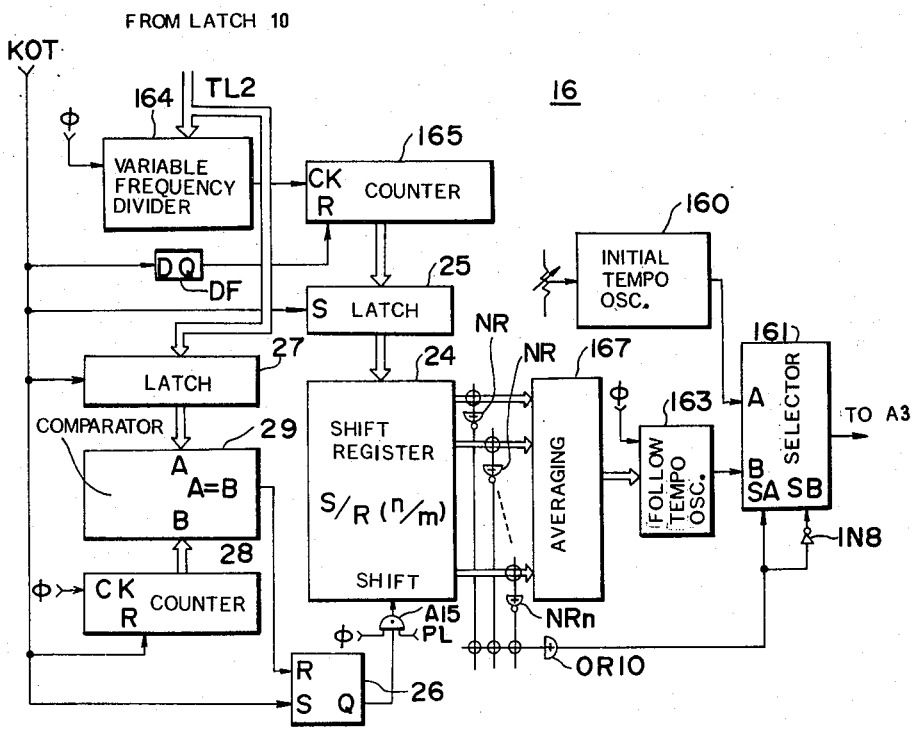
FIG. 5 is a block diagram showing another example of the tempo control circuit.

FIG. 5 shows another preferred configuration of the tempo control circuit 16. In the configuration shown in FIG. 4, the same effect on the follow tempo pulse is given to every key depression timing regardless of the length of note while in this configuration the extent of the effect on the follow tempo pulse is intended to be changed according to the note length. That is, it is configured so that a note of a long length has a greater effect on the follow tempo pulse than a note of a short length, since when the key depression tempo is evaluated by converting to a value independent of the length, if a note of a short length is handled the same as a note of a long length, the shorter the length, the greater the effect on the following tempo pulses becomes. For the description of FIG. 5, to the portions that perform the same functions as the circuits shown in FIG. 4 the same symbols or numbers are assigned so as to simplify the explanation. In this configuration, the selector 161 selects the output of an initial tempo oscillator 160 which is to be fed to the A input, and outputs what has been selected. That is, if the output of an OR circuit OR10, which takes the OR condition of the outputs of NOR circuits NR1 through NRn to which individual bit outputs of individual stages of a shift register 24 (mentioned later) are applied respectively, is "1" (if there is a stage of the shift register 24 whose output bits among the parallel outputs of stages are all "1"), this signal is fed to the A input select terminal SA of the selector 161, and the selector 161 selects and outputs the initial tempo pulse outputted from the initial tempo oscillator 160.

On the other hand, the length data TL2 latched at a latch circuit 10 is fed to a variable frequency divider 164, and the variable frequency divider 164 generates pulse signals of the perod corresponding to the length data TL2. These pulse signals are counted by a counter 165 which is reset upon each key-on timing signal KOT, and are latched by a latch circuit 25 each time of key-on timing signal KOT. The value latched to the latch circuit 25 is fed to the shift register 24.

The shift register 24 comprises "n" stages and "m" bits, and picks up values latched at the latch circuit 25 as much as the number of stages corresponding to the length.

To a shift terminal of the shift register 24 are applied the output of a flip-flop 26 which is set by a key-on timing signal KOT and a clock pulse $\phi$ through an AND circuit A15 which is made ready to operate by a play signal PL, and as the flip-flop 26 is set by a key-on timing signal KOT, the shift register 24 sequentially picks up values latched at the latch circuit 25. The length data TL2 latched at the latch circuit 10 is latched at a latch circuit 27 by a key-on timing signal KOT, a counter 28 (a key-on timing signal KOT is applied to its reset terminal R) starts counting clock pulses $\phi$ synchronized with the key-on timing signals KOT, and the output of the latch circuit 27 is compared with the output of the counter 28 in a comparator 29. As the count value of the counter 28 reaches the length data TL2 latched by the latched circuit 27 and a coincidence output is generated at the comparator 29, this coincidence output is applied to a reset terminal R of a flip-flop 26, causing the flip-flop 26 to be reset. As a result, the AND circuit A15 becomes nonoperative, and the shift operation of the shift register 24 stops. That is, the number of stages in which data latched at latch circuit 25 are shifted at the shift register 24 for a single key-on timing signal KOT becomes increased if the length data TL2 is large, and becomes small if the length data TL2 is small, thus becoming the number corresponding to the length data TL2. For example, if the length data TL2 corresponds to a crotchet, and data for "k" stages are loaded in the shift register 24, data for k/2 stage are loaded in the shift register if the length data TL2 corresponds to a quaver. The content of each stage of the shift register 24 is averaged at the averaging circuit 167, and is applied to a follow tempo oscillator 163.

When each stage of the shift register 24 is filled with data and data relative to the first tone reaches the last stage of the shift register 24, the output of the OR circuit OR10 becomes "0", and the output of the OR circuit OR10 is applied to the B input select terminal SB of the selector 161 through an inverter IN8. As a result, the selector selects a follow tempo pulse which follows the key depression tempo being outputted from the follow tempo oscillator 163, and subsequently outputs said pulse.

Figure 6:
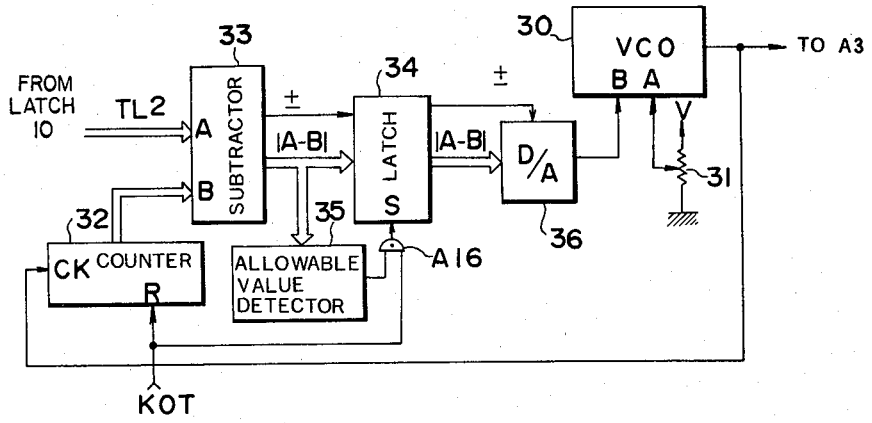
FIG. 6 is a block diagram showing still another example of the tempo control circuit.

FIG. 6 shows still another preferred configuration of the tempo control circuit 16. In this configuration, the tempo pulse is designed to be corrected based on the difference between the length data TL1 and the length formed by the tempo pulse. In this configuration, tempo pulses are formed by a voltage control type oscillator (VCO) 30. The VCO 30 is provided with a manual tempo setting terminal A and a correction terminal B. The initial tempo is set at the manual tempo setting terminal A by a manual tempo setter (variable resistor) 31. Tempo pulses outputted from the VCO 30 are fed to the clock input of a counter 32. To a reset terminal of the counter 32 is applied a key-on timing signal KOT, and the counter 32 is reset each time a key-on timing signal KOT is applied, and counts tempo pulses TP. The count value of this counter 32 corresponds to the length formed by the tempo pulse TP. The count value of the counter 32 is fed to a B input of a subtractor 33.

The subtractor 33 has an A input to which the length data TL2 latched at the latch circuit 10 is applied, and subtracts the count value of the counter 32 from said length data TL2. Signals representing the subtracted value $|A-B|$ and its sign $\pm$ are applied to a latch circuit 34. The subtracted value $|A-B|$ outputted from the subtractor 33 is also applied to an allowable value detection circuit 35. The allowable value detection circuit 35 compares the preset allowable value with the subtracted value $|A-B|$, and adds a signal "1" to an AND circuit A16 if the subtracted value is within the allowable value. To the other input of the AND circuit A16 is applied a key-on timing signal KOT, and the AND circuit A16 outputs a signal "1" synchronized with the key-on timing signal KOT provided that the subtracted value at the subtractor 33 is within the allowable value. This signal is fed to the strobe terminal S of the latch circuit 34. That is, the latch circuit 34 latches the output of the subtractor 33 at the timing of the key-on timing signal KOT provided that the output of the subtractor 33 is within the allowable value. The allowable value detection circuit is provided so that the tempo pulse does not follow a great change in the key depression tempo. The output of the latch circuit 34 is converted to an analog signal by a digital-to-analog converter 36, and is fed to the correction terminal B of the VCO 30.

Though a single latch circuit is employed in the configuration of FIG. 6, multiple stage latch circuits may be used as shown in the configuration of FIG. 4 with an averaging circuit provided to obtain an average value.

Figure 7:
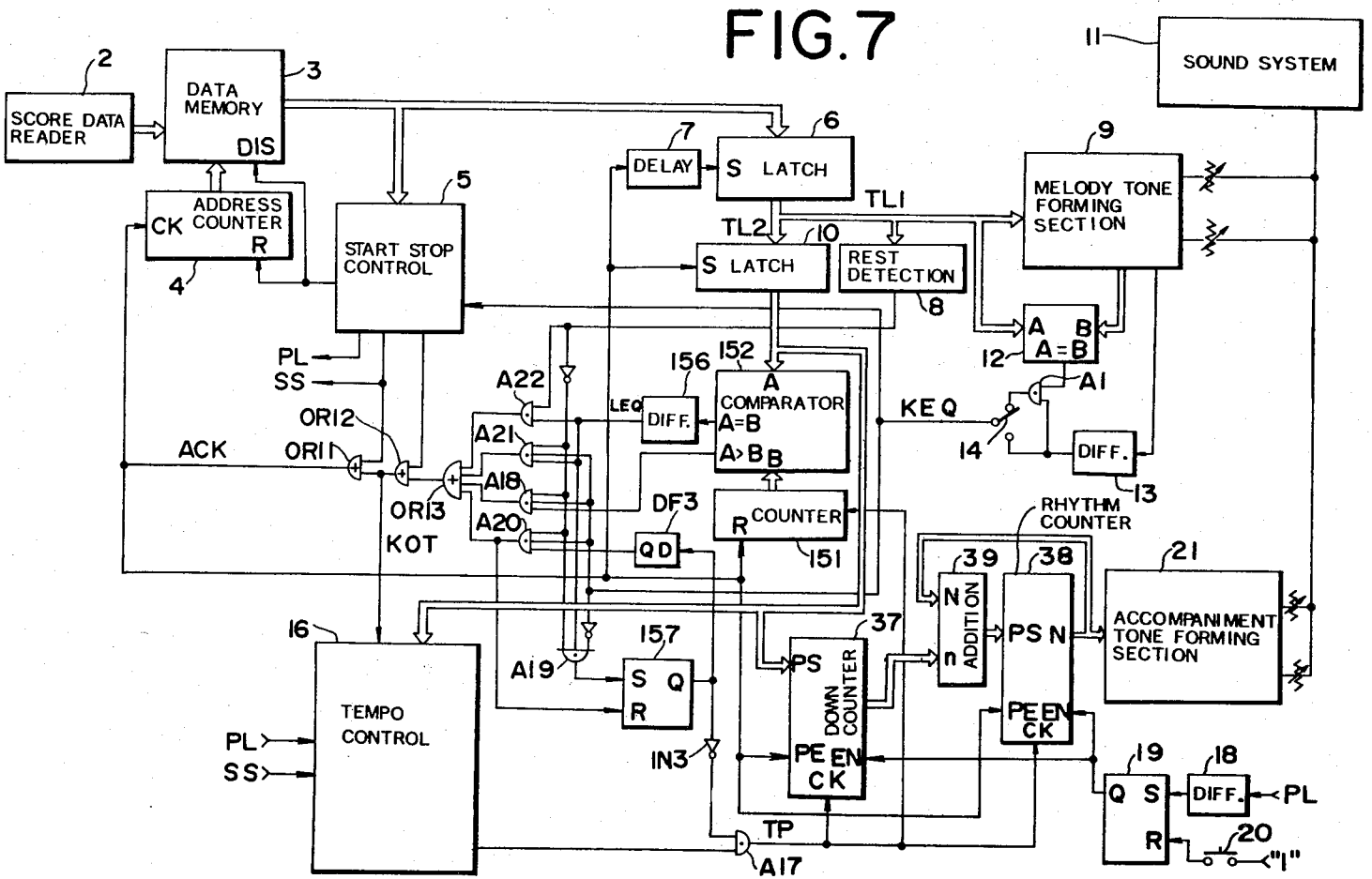
FIG. 7 is a block diagram of another embodiment of this invention.

FIG. 7 shows another embodiment of the invention. This embodiment is so constructed that whereas the operation, when the key depression timing lags behind the length data and when the former and the latter coincide with each other, is the same as the operation of the embodiment shown in FIG. 1, delay of the automatic performance is directly preset by jumping operation at the rhythm counter when the former occurs earlier than the latter. The portions in FIG. 7 which are in common with those in FIG. 1 are indicated by the same reference numerals and symbols, and the explanation is omitted.

As a start-set switch (not shown) is depressed in a start-stop control circuit 5, a data memory 3 becomes ready to operate, and the reset state of an address cunter 4 is released. The start-stop control circuit 5 generates a start-set signal SS, this signal SS is fed to the clock terminal CK of an address counter 4 through an OR circuit OR11 as an address clock signal ACK, advancing the address counter 4 by one step. As a result, data D1 relative to the first tone is read from the data memory 3, and is latched at a latch circuit 6 by a signal which is the address clock signal ACK delayed at a delay circuit 7. The signal latched at the latch circuit 6 is fed to a rest detection circuit 8 for the rest detection, also fed to a melody tone production section 9, and indicates the key of the first tone.

As the key of the first tone is depressed in this state, a coincidence output is issued from a comarator 12, an AND circuit A1 becomes ready to operate, and a key depression coincidence signal KEQ is outputted through a select switch 14. This key depression coincidence signal KEQ is first applied to the start-stop control circuit 5, causes it to output a signal indicating the depression of the key of the first tone, and applies this signal to the clock input of the address counter 4 through OR circuits OR12 or OR11 as an address clock signal ACK. The output of the OR circuit OR11 is fed to a strobe terminal S of a latch circuit 10, and latches the length data TL2 of the data relative to the first tone latched at the latch circuit 6. The output of the OR circuit OR11 is also applied to a reset terminal R of a counter 151, a preset terminal PE of a downcounter 37, and a preset terminal PE of a rhythm counter 38. As a result, the counter 151 is reset, and the length data TL2 latched at the latch circuit 10 is preset at the downcounter 37. At this time, the rhythm counter 38 is preset to the initial value.

When the next key depression timing occurs earlier than the length data TL2 latched at the latch circuit 10 in this state, the relation $A>B$ is established at a comparator 152 wherein the count value of the counter 151 which counts tempo pulses TP outputted from the tempo control circuit 16 through an AND circuit A17 is compared with the output of the latch circuit 10, and the AND condition at an AND circuit A18 is established. The output of this AND circuit A18 is sent out as an address clock signal ACK through OR circuits OR13, OR12, and OR11.

On the other hand, to the down-counter 37 and the rhythm counter 38 are applied tempo pulses TP outputted from the AND circuit A17, and down-count and up-count are made according to these tempo pulses TP. Accordingly, in this case, the count value "n" of the down-counter 37 at the time when the output is issued from the OR circuit OR11 is $n>0$. The count value "n" of this downcounter 37 is added to the count value N of the rhythm counter 38 at an adder 39, and the value $N+n$ is preset to the rhythm counter 38 at the output timing of the OR circuit OR11. That is, by presetting the value $N+n$ to the rhythm counter 38, the delay n of the rhythm counter 38 with respect to the key depression timing is cancelled. The counter 151 is reset by the output of the OR circuit OR11, the length data TL2 relative to the next tone is latched at the latch circuit 10, and the length data TL2 latched at the latch circuit 10 is preset to the down-counter 37.

When the key depression timing lags behind the length data TL2 latched at the latch circuit 10, the relation $A=B$ is established at the comparator 152 prior to the generation of a key depression coincidence signal KEQ, and a length equal signal LEQ is generated at a differentiation circuit 156. As a result, the AND condition is established at the AND circuit A19, and a flip-flop 157 is set. The output Q of this flip-flop 157 is fed to the AND circuit A17 through an inverter IN3, making the AND circuit A17 nonoperative. That is, said output Q causes the tempo pulse to stop and causes the automatic performance to stop. The output Q of the flip-flop 157 is fed to an AND circuit A20 through a delay flip-flop DF3. This AND circuit A20 outputs a signal "1" at the timing when a key depression coincidence signal KEQ is generated, and causes the OR circuit OR11 to generate an address clock signal ACK. At this time, the count value n of the down-counter 37 is "0". Accordingly, the output of the adder 39 is equal to the count value N or the rhythm counter 38, and N is preset to the rhythm counter 38 by the output of the OR circuit OR11. The output of the AND circuit A20 is applied to the reset terminal R of the flip-flop 157, resetting the flip-flop 157. As a result, the AND circuit A17 becomes operable, and the automatic performance is released from being stopped.

When the key depression timing and the length data TL2 latched at the latch circuit 10 coincide with each other, the AND condition of an AND circuit A21 is established, and an address clock signal ACK is generated at the OR circuit OR11. At this time, the count value n of the counter 37 is "0", and the value to be preset to the rhythm counter 38 by the output of the OR circuit OR11 is equal to the count value N of the rhythm counter 38. That is, the automatic performance progresses uncontrolled.

Upon the detection of a rest at the rest detection circuit 8, the relation $A=B$ is established at the comparator 152, the AND condition of an AND circuit A22 is established at the timing when a length equal signal LEQ is generated, and an address clock signal ACK is generated at the OR circuit OR11.

In this embodiment, the key-on timing signal KOT to be used at the tempo control circuit 16 is obtained from the output of the OR circuit OR12.

Figure 8:
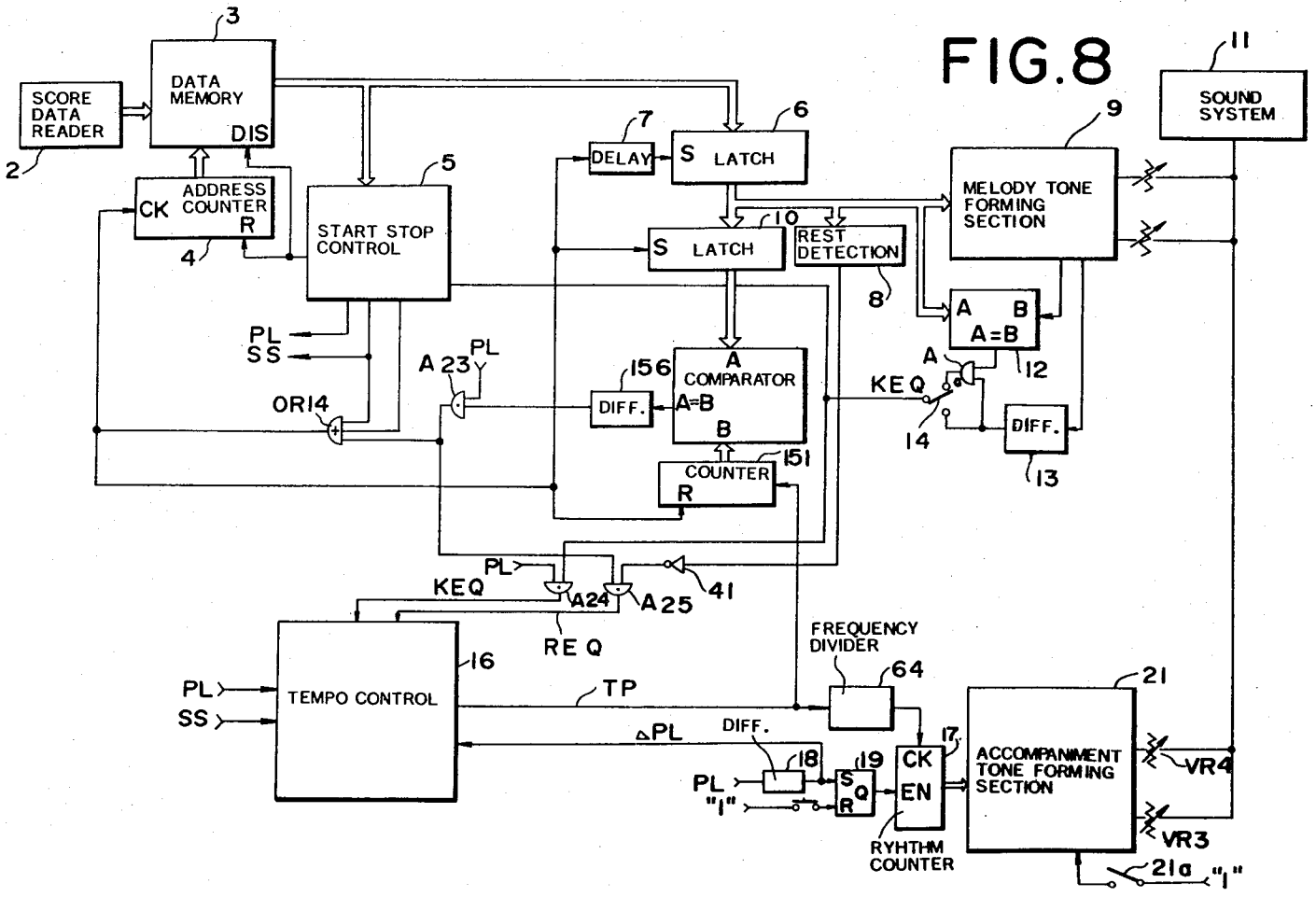
FIG. 8 is a block diagram of still another embodiment of this invention.

FIG. 8 shows still another embodiment of the invention. This embodiment is constructed so as to enable variable countrol of the frequency of the tempo pulse according to the relation between the key depression timing and the length data, i.e., whether the key depression timing is faster or slower than the length data. The portions in common with FIG. 8 and FIGS. 1 through 7 are indicated by the same reference numerals and symbols, and the description for those portions are omitted.

If assumption is made that data D1 relative to the first note is read and latched at a latch circuit 6, and then the key for the first note is depressed, the result would be that a coincidence signal is generated at a comparator circuit 12, an AND circuit A1 becomes operable, and a key depression coincidence signal KEQ is outputted through a select switch 14. This key depression coincidence signal KEQ is first applied to a start-stop control circuit 5, causing said start-stop control circuit 5 to output a signal indicating the depression of the key for the first note. This signal is fed to the clock input of an address counter 4 as an address clock signal ACK through an OR circuit OR14. Accordingly, a counter 4 supplies an address signal to a memory 3 to indicate a data read address corresponding to the second note, and from the memory 3 is read a score data corresponding to the second note. This score data is latched at the latch circuit 6 according to the output signal of the OR gate OR14. On the other hand, a score data corresponding to the first note latched at the latch circuit 6 is latched by a latch circuit 10 according to the output signal of the OR gate OR14.

A counter 151 counts tempo clock signals TP fed from a tempo control circuit 16 after reset by the output signal of the OR gate OR14 synchronized with the latch timing of the latch circuit 10. The length data TL2 from the latch circuit 10 and the count output of the counter 151 are fed to a comparator 152 for comparison.

When the count output of the counter 151 coincides with the length data TL2 from the latch circuit 10, the comparator issues a length equal LEQ, the length equal signal LEQ is fed to one input terminal of an AND gate A23 as it is differentiated at its rising edge by a differentiation circuit 156. Since a play signal PL is fed from the start-stop control circuit 5 to the other input terminal of the AND A23, the AND gate A23 sends out the equal pulse signal from the differentiation circuit 156 to the OR gate OR14. Accordingly, from the OR gate OR14 is sent out an output signal at the time when the count value of tempo clock signals TP reached the time corresponding to the length of the first note, and this output signal is supplied to the counter 4, latch circuits 6 and 10, and counter 151. Consequently, the counter 4 acts to cause the pitch data and the length data corresponding to the third note to be read from the memory 3, and a length measuring section containing the latch circuit 10, the counter 151 and the comparator 152 performs the length measurement as to the second note in the same manner as previously performed in the first note. Similarly, for subsequent notes data is read from the memory 3 and length measurement is performed respectively, and at the last step the end data is read from the memory 3.

The latch circuit 6 sequentially latches score data according to the score data read operation, and the pitch data TL1 of the latch output is fed to a rest detection circuit 8. The rest detection circuit 8 generates an output signal upon detecting that all key code bits of the pitch data TL1 are "0". This output signal is fed to one input terminal of an AND gate A25 through an inverter 41, and to the other terminal of the AND gate A25 is fed a pulse signal synchronized with the data read timing from the AND gate A23. From the output terminal of the AND gate A25 is sent out a pulse signal REQ synchronized with the read timing of the note data provided that no output signal is issued from the rest detection circuit 8, and the signal REQ is fed to the tempo control circuit 16.

The key-on signal from a differentiation circuit 13 is fed to the fixed contact a of the select switch 14, and to the fixed contact b of the switch 14 is fed a key-on signal which is the same as the input of the AND gate A1. It is so constructed that in the case of a beginner class performer, the movable contact of the select switch switch 14 is switched to the fixed contact a, and in the case of an advanced class performer the movable contact is switched to the fixed contact b. The key depression coincidence signal KEQ is fed to the start-stop control circuit 5 and to one input terminal of an AND gate A24. Since the performance signal PL is fed to the other input terminal of the AND gate A24, the AND gate A24 supplies a key depression coincidence signal KEQ to the tempo control circuit 16 each time key-on is performed.

An R-S flip-flop 19 is set by a performance start signal ΔPL formed as the result of the rising edge differentiation of the play signal PL at a differentiation circuit 18, and is reset by an ON signal from a stop switch 20, thus enabling a counter 60 by its output Q for the control of an accompaniment tone forming section 21.

A counter 17 counts signals which are tempo clock signals TP delivered from a tempo control circuit 16 divided by a frequency divider 64. The counter 17 starts counting synchronized with a play start timing and stops its counting operation in synchronism with on-timing of a stop switch 62.

The composition and the operation of the tempo control circuit 16 shown in FIG. 8 is now described.

Figure 9:
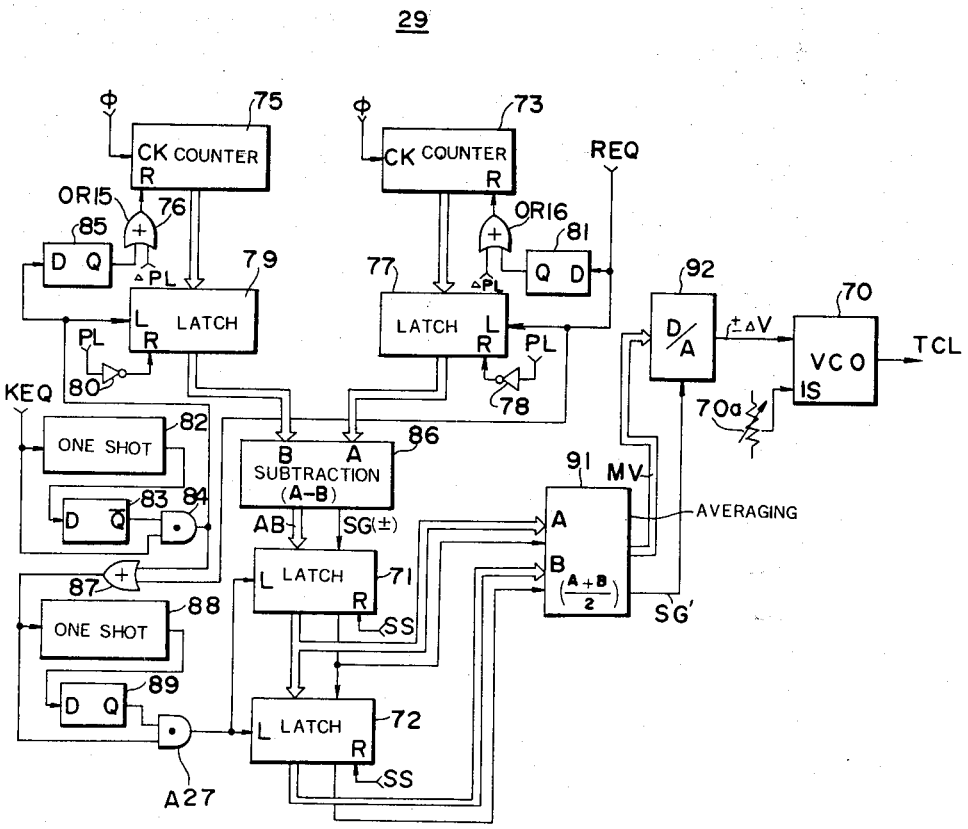
FIG. 9 is a detailed diagram showing a tempo control circuit in this invention.

In FIG. 9, a tempo oscillator circuit 70 comprises a voltage control type variable frequency oscillator VCO, and in the initial condition the VCO sends out tempo clock signals TP of a specified frequency according to an initial setting voltage signal IS from a variable resistor 70*a*. When a start signal SS is generated, latch circuits 71 and 72 are reset according to the start signal SS.

Then, when a key depression coincidence signal KEQ corresponding to the first tone is generated, a play signal PL and a play start signal ΔPL are generated as already mentioned. A counter 73 is reset by the play start signal ΔPL supplied through an OR gate OR16, and a counter 75 is reset by the play start signal ΔPL fed through an OR gate OR76. A latch circuit 77 is released from being reset by the play signal PL fed through an inverter 78, and a latch circuit 79 is released from being reset by the play signal PL fed through an inverter 80.

After being reset, the counters 73 and 75 count clock signals $\phi$ (frequency thereof sufficiently higher than TCL), and the count output of the counter 73 and that of the counter 75 are supplied to corresponding latch circuits 77 and 79 respectively.

Upon reaching the time corresponding to the duration (length) of the first note after the time when key-on is performed corresponding to the first note (corresponds to the read time of the note data corresponding to the second note), a pulse signal REQ is generated synchronized with the read timing of the note data corresponding to the third note as mentioned previously. This pulse signal REQ is fed to the latch circuit 77 as a latch command signal L, and is also fed to a D flip-flop 81 as well as to the counter 73 through an OR gate OR16 as a reset signal R. As a result, the latch circuit 77 latches the count output of the counter 73 according to the pulse signal REQ, and the counter 73 is reset after a short time corresponding to the delay of the flip-flop 81 from the above latch timing. After being reset, the counter 73 counts clock pulses $\phi$ again.

On the other hand, if the assumption is made that the key-on corresponding to the second note is performed slightly delayed from the time when the pulse signal REQ is generated, a key depression coincidence signal KEQ is fed to a one-shot circuit 82, and the output of this one-shot circuit 82 is fed to a D flip-flop 83. The output Q of the flip-flop 83 is fed to an AND gate 84, and is subjected to the AND operation with the key depression coincidence signal KEQ.

Figure 10:
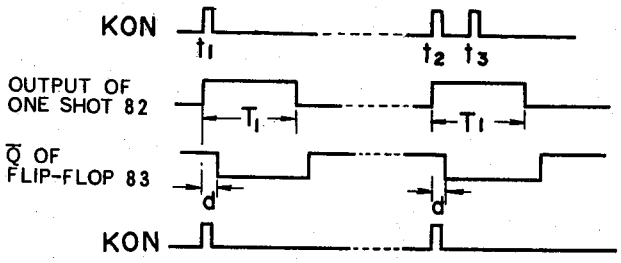
FIGS. 10 and 11 are time charts illustrating the operation of the tempo control circuit in FIG. 9.

A circuit containing the one-shot circuit 82, the flip-flop 83 and an AND gate A26 is provided for stopping a key-on signal resulted from erroneous key-on operation, such as continuous key-on, and, for example, operation such as shown in FIG. 10 is performed. That is, if assumption is made that a key depression coincidence signal KEQ is generated at point $t_1$, the output of the one-shot circuit 82 remains at the level "1" during the $T_1$ period. Since the output Q of the flip-flop 83 becomes "1" during a short period d in which the output of the one-shot circuit 82 is delayed, the key depression coincidence signal KEQ is sent out during that "1" period through the AND gate A26. Then if key depression coincidence signal KEQ is consecutively generated at $t_2$ and $t_3$, the key depression coincidence signal at $t_2$ is sent out as a KEQ' through the AND gate A26 similar to the case at $t_1$ while the key depression coincidence signal at $t_3$ is stopped by the AND gate A26 since the output Q of the flip-flop 83 is "0".

A key depression coincidence signal KEQ' generated at the AND gate A26 corresponding to the second note is fed to the latch circuit 79 as a latch command signal L, and is also supplied to the counter 75 through a D flip-flop 85 and an OR gate OR15 as a reset signal R. As a result, the latch circuit 79 latches the count output of the counter 75 according to the key depression coincidence signal KEQ'. The counter 75 is reset after a short time delay from the above latch timing corresponding to the delay of the flip-flop 85, and then resumes counting of clock signals $\phi$.

The count data thus latched at the latch circuits 77 and 79 are fed to a subtractor 86 as inputs A and B respectively. As the result of subtraction A−B, the subtractor 86 generates a signal AB indicating the absolute value of the difference |A−B| and a signal SG indicating a sign (+ or −) to be prefixed to the absolute value of difference. In the above example, since the key-on timing of the second note is somewhat delayed against the read timing (automatic performance timing) of the third note, the relation between the inputs A and B becomes A<B. Accordingly, an absolute value signal AB is generated corresponding to the value of B exceeding A, and a sign signal SG indicating a minus (−) is generated.

Figure 11:
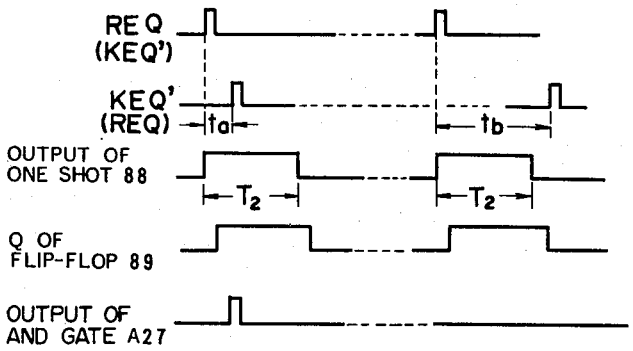

On the other hand, a key depression coincidence signal KEQ' and a pulse signal REQ are fed to an OR gate OR17, and the output signal of this OR gate OR 17 is fed to a one-shot circuit 88. The output of the one-shot circuit 88 is fed to an AND gate 90 after a short delay at a D flip-flop 89, and is subjected to the AND operation with the output signal of an OR gate 87. A circuit containing the one-shot circuit 88, the flip-flop 89 and an AND gate A27 is provided for supplying a latch command signal L to latch circuits 71 and 72 ony when the time interval between the key depression coincidence signal KEQ' and the pulse signal LEQ is less than the specified value (almost equal to the output duration of the one-shot circuit 88), and operates as shown in FIG. 11, for example. As shown in the left part of FIG. 11, when a key depression coincidence signal KEQ' is generated after delay $t_a$ smaller than the output duration $T_2$ of the one-shot circuit 88 with respect to a pulse signal REQ, that key depression coincidence signal KEQ is sent out through the AND gate A27, while, as shown in the right part of FIG. 11, when a key depression coincidence signal KEQ' is generated after delay $t_b$ larger than the output duration $T_2$ of the one-shot circuit 88 with respect to a pulse signal REQ, the key depression coincidence signal KEQ' is stopped at the AND gate A27. Such operation is performed in the same manner when the relation of the time between the generation of pulse signal REQ and that of the key depression coincidence signal KEQ' is opposite to the above case.

As a latch command signal L is generated from the AND gate A27 according to a key depression coincidence signal KEQ' corresponding to the second note, the latch circuit 71 latches the absolute value signal AB and the sign signal SG from the subtractor 86 according to said latch command signal L.

Then, as a data corresponding to the fourth note is read (automatic performance), and after a short time the key-on corresponding to the third note is performed, an absolute value signal AB and a sign signal SG are generated from the subtractor 86 similar to the above, and are latched at the latch circuit 71. The subtraction data corresponding to the second note latched at the latch circuit 71 previously is latched by the latch circuit 72 before the subtraction data corresponding to the third note of the latch circuit 71 is latched.

Accordingly, to an averaging circuit 91 are supplied subtraction data (absolute value signal and sign signal) corresponding to the second and the third notes from the latch circuits 71 and 72 respectively as inputs A and B, and as the result of averaging operation (A+B)/2 a mean value signal MV and sign signal SG' are generated from the averaging circuit 91. In the above example, since the key-on timing is delayed to some extent with respect to the automatic performance timing relative to the second and the third notes, the means value signal MV is generated according to said delay and the sign signal SG' indicating a minus (−) is generated.

The mean value signal MV and the sign signal SG' are fed to an digital-to-analog converter 92, and are converted to a corresponding analog signal $+\Delta V$ or $-\Delta V$. In the above example, since the sign signal SG' indicates a minus, an analog signal of $-\Delta V$ is generated as the output of the converter 92.

The analog signal $+\Delta V$ or $-\Delta V$ is fed to a tempo oscillator 70, and acts to increase or decrease the frequency of the tempo clock signal TP by the value corresponding to $\Delta V$, and as a result the tempo of the automatic performance is quickened or slackened accordingly. In the above example, since the frequency of the tempo clock signal TP is lowered according to the analog signal $-\Delta V$, the tempo of the automatic performance is slackened according to the tempo of the automatic performance. In the case when the tempo of the manual performance is quick with respect to the tempo of the automatic performance contrary to the above example, sign signals SG and SG' indicating a plus (+) and an analog signal $+\Delta V$ are generated in the similar fashion as above, and the tempo of the automatic performance is quickened following the tempo of the manual performance.

Though in the above-mentioned embodiments the key depression coincidence signal KEQ is employed as a pulse signal synchronized with the performance timing, it may be designed so that pulse signals synchronized with the performance timing are issued from a nonkeyboard type musical instrument, such as a guitar, and these pulse signals are used in lieu of key depression coincidence signals.

Furthermore, though in those embodiments the melody tone to be performed is always produced one tone in advance by the automatic performance melody tone forming circuit to facilitate the melody performance by the performer, it is also possible that an obbligato generating circuit which stores obbligato data is provided so as to enable the automatic performance of obbligato to color the performance of the performer.

When a plurality of tones of the same scale are consecutively occur, the length data and pitch data may be formed taking these tones as a single tone. Such arrangement provides the stability of the tempo particularly when short length (time) notes consecutively appear.

In addition, an arrangement in which data are formed picking up only significant notes of melody tones is feasible. Data may be simplified in this way.

In the case of the embodiment of FIG. 1, the first feed clock generated when the key depression timing is fast may be caused to follow the tempo, to become exponentially faster from a moment when a key depression timing coincides with the corresponding length data or to become exponentially slower toward the restart. Such arrangement facilitates the follow-up operation of the automatic performance.

When the frequency of tempo pulses are controlled by the past n tempo data ($n=1,2,3,\ldots$), weight may be assigned to each data. For example, if a greater weight is assigned to a tempo data of nearer past, tempo control will become more natural.

It will be readily understood that score data which provide the basic information of the automatic performance concerning the pedal keyboard and the lower keyboard are also applicable to these embodiments according to this invention.

We claim:

1. An automatic performance device including memory means storing musical data and read-out means therefor, said musical data including automatic performance tone generation timing data, and wherein automatic performance is carried out in accordance with said musical data successively read out from said memory means by said read-out means, comprising:

keyboard means provided with a plurality of keys for generating a key relation signal in response to a depressed key among said keys;

tone signal producing means for producing a tone signal in response to said depressed key; and control means connected to said keyboard means and said memory means for supplying a control signal to said read-out means, said control signal being generated in accordance with a comparison between (a) a measured time interval between the time of readout of said timing data and the generation of said key relation signal and (b) said tone generation timing data, so that the occurrence time of subsequent read-out of said musical data is controlled in accordance with the result of said comparison.

2. An automatic performance device according to claim 1, wherein said musical data further includes data indicating tone pitch, further comprising a comparator for comparing the pitch of said depressed key with said tone pitch indicating data and for generating said key relation signal in response to coincidence therebetween.

3. An automatic performance device according to claim 1, wherein said musical data includes the data indicating tone pitch of said depressed key, further comprising tone generating means for generating a tone corresponding to said musical data.

4. An automatic performance device according to claim 1, wherein said musical data includes the data indicating tone pitch of said depressed key, further comprising display means for displaying in accordance with said musical data.

5. An automatic performance device including memory means storing musical data and read-out means therefor, said musical data including automatic performance tone generation timing data, and wherein automatic performance is carried out in accordance with said musical data successively read out from said memory means by said read-out means, comprising:

keyboard means provided with a plurality of keys for generating a key relation signal in response to a depressed key among said keys;

tone signal producing means for producing a tone signal in response to said depressed key; and control means connected to said keyboard means and said memory means for supplying a control signal to said read-out means, said control signal being generated according to said key relation signal and to said tone generation timing data so that the occurrence time of subsequent read-out of said musical data is controlled in accordance with the time relationship therebetween, and wherein;

said control means comprises a fast feed control circuit for advancing the occurrence time of the next event of said automatic performance when said key relation signal is generated before the timing designated by said read out tone generation timing data.

6. An automatic performance device according to claim 5, wherein said control circuit comprises a data forming circuit for forming difference data corresponding to a time difference between said key relation signal and the timing designated by said read out tone generation timing data.

7. An automatic performance device according to claim 5, wherein said control means comprises a stop control circuit for temporarily stopping the progress of the automatic performance when said key relation signal is generated after the timing designated by said read out tone generation timing data.

8. An automatic performance device including memory means storing musical data and read-out means therefor, said musical data including automatic performance tone generation timing data, and wherein automatic performance is carried out in accordance with said musical data successively read out from said memory means by said read-out means, comprising:

keyboard means provided with a plurality of keys for generating a key relation signal in response to a depressed key among said keys;

tone signal producing means for producing a tone signal in response to said depressed key; and control means connected to said keyboard means and said memory means for supplying a control signal to said read-out means, said control signal being generated according to said key relation signal and to said tone generation timing data so that the occurrence time of subsequent read-out of said musical data is controlled in accordance with the time relationship therebetween, and wherein;

said read-out means comprises a tempo pulse generator for generating a tempo pulse and said control means comprises a tempo control circuit for forming difference data corresponding to a time difference between said key relation signal and said tone generation timing data and for supplying said difference data to said tempo pulse generator.

9. An automatic performance device according to claim 8 further comprising a clock pulse generator for generating clock pulses established by said tone generation timing data, wherein said tempo control circuit counts said clock pulses at every key depression timing and controls the period of said tempo pulse corresponding to a value determined based on the count value thus counted.

10. An automatic performance device according to claim 8 further comprising a clock pulse generator for generating clock pulses established by said tone generation timing data, wherein said tempo control circuit counts said clock pulses at every key depression timing and controls the period of the tempo pulse by comparing the count value thus counted with said musical data.

11. An automatic performance device according to claim 8 further comprising a clock pulse generator for generating clock pulses established by said tone generation timing data, wherein said tempo control circuit counts said clock pulses at every key depression timing and at every read-out timing and controls the period of said tempo pulse by using the difference between the count values thus counted at said timings.

12. An automatic performance device including memory means storing musical data and read-out means therefor, said musical data including automatic performance tone generation timing data, and wherein automatic performance is carried out in accordance with said musical data successively read out from said memory means by said read-out means, comprising:

keyboard means provided with a plurality of keys for generating a key relation signal in response to a depressed key among said keys;

tone signal producing means for producing a tone signal in response to said depressed key; and control means connected to said keyboard means and said memory means for supplying a control signal to said read-out means, said control signal being generated according to said key relation signal and to said tone generation timing data so that the occurrence time of subsequent read-out of said musical data is controlled in accordance with the time relationship therebetween, and wherein;

said read-out means comprises a tempo pulse generator for generating tempo pulses, and said control means comprises a counter, a comparator and a control signal generator, said comparator being connected to said counter and said memory means for comparing the content of said counter with said musical data, said counter counting said tempo pulses, said control signal generator being connected to said keyboard means and to said comparator for generating said control signal.

13. An automatic performance device according to claim 9, wherein said determined value is an average value of said count values corresponding respectively to a plurality of key depressions.

14. An automatic performance device according to claim 13, wherein said count values corresponding respectively to a plurality of key depressions are weighted and said determined value is an average value of the weighted count values.

15. An automatic performance device according to claim 14, wherein said values are weighted in such manner that a newer value has a greater weight.

16. In an electronic musical instrument of the type in which musical melody note name and note interval timing data for consecutive notes of a musical composition are prestored, said data for consecutive notes being read out individually and used to indicate a note to be played, the improvement comprising:

means for comparing (a) the measured elapsed time between the time of readout of each individual data and the time that the corresponding indicated note is played with (b) the read out note interval timing data and for providing an output indicative of said comparison, and means for altering the time of readout of the next melody note data in response to the output of said means for comparing.

17. An electronic musical instrument of the type in which stored musical melody note name and note interval timing data is read out and used to indicate a note to be played, the improvement comprising:

means for comparing the actual time that said indicated note is played with the read out note interval timing data and for providing an output indicative of said comparison, and means for altering the time of readout of the next melody note data in response to the output of said means for comparing, and wherein said means for altering includes;

first circuit means for immediately reading out the next melody note data in the event that the indicated note is played prior to the timing interval designated by said read out note interval timing data, and second circuit means for delaying readout of the next melody note data in the event that the indicated not is played later than the timing interval designated by said read out note interval timing data.

18. An electronic musical instrument according to claim 17 and further including an automatic accompaniment device, said second circuit means also inhibiting said accompaniment device while delaying said readout.

19. In a keyboard electronic musical instrument of the type in which note name and note interval timing data for consecutive notes of a musical composition are prestored, said data for consecutive notes being sequentially read out at a certain rate and used to indicate a desired key performance, the improvement comprising:

tempo pulse means for producing tempo pulses which establish said certain readout rate, tempo follow-up means, cooperating with said tempo pulse means, for adjusting the occurrence rate of said tempo pulses and hence adjusting said readout rate in response to a comparison between (a) the elapsed time between data readout and actual key depression and (b) the value of the corresponding read out timing data.

20. The improvement of claim 19 wherein said tempo follow-up means comprises:

means for determining if said elapsed time of key depression for several successive notes on the average leads or lags the required between note interval timing indicated by said data, and for adjusting said tempo pulse occurrence rate in response thereto.

21. An automatic performance device with tempo follow-up function comprising:

memory means for storing performance timing information including note-length timing information of musical tones to be performed;

an operator element;

read-out means for sequentially reading out the performance timing information from said memory means in accordance with the sequence of performance;

timing judgment means for comparing the actual measured time interval until operation of said operator element with the note-length timing information read out from said memory means;

automatic performance means for performing an automatic performance; and tempo control means for controlling the tempo of the automatic performance by said automatic performance means in accordance with the results of said comparing by said timing judgment means.

22. An automatic performance device according to claim 21, wherein said operator element is any of keys of a keyboard.

23. An automatic performance device according to claim 21, wherein said operator element is a key corresponding to each tone to be performed, and the subsequent readout of performance timing information by said read-out means and said comparing of the actual measured time interval by said timing judgment means are carried out only when a correct key is operated.

24. An automatic performance device according to claim 21, wherein said timing judgment means comprises;

means for establishing a set of timing pulses occurring at rate inversely proportional to the read out performance note-length timing information, and means for counting said timing pulses during the interval between the time of readout of said note-length timing information and the time of operation of said operator element, a comparison between said actual measured time interval and the timing specified by said note-length timing information being indicated by the extent to which the number of pulses counted by said means for counting differs from a preestablished count value.

25. An automatic performance device according to claim 24, wherein said means for establishing comprises a variable frequency divider circuit for dividing the frequency of a sequence of clock pulses by a predetermined frequency dividing ratio corresponding to said read out note-length timing information, and wherein said means for counting comprises a counter for counting the output pulses of said variable frequency divider circuit and allowing the counted value to be reset at each operation of said operator element, and outputs the counted value of said counter at every operation of said operator element.

26. An automatic performance device according to claim 24 further comprising:

an averaging circit, connected to the output of said means for counting, for averaging the measured time invervals of a plurality of operations of said operator element, said controlling by said tempo control means being based on the output of said averaging circuit.

27. An automatic performance device according to claim 26, wherein said averaging circuit averages the outputs of said means for counting afer performing a predetermined weighting of said output.

28. An automatic performance device according to claim 27, wherein said weighting is carried out corresponding to said note-length information.

29. An automatic performance device according to claim 27, wherein said weighting is carried out corresponding to the outputting order of the outputs from said means for counting.

30. An automatic performance device according to claim 21, wherein said timing judgment means outputs the result of said comparing only when said result falls within the predetermined allowable range.

31. An automatic performance device according to claim 21, wherein said timing judgment means comprises a time difference detector circuit for detecting the time difference between the timing designated by said note-length timing information and the actual measured time interval of said operator element, the output of said time difference detector circuit representing the result of said comparing.

32. An automatic performance device according to claim 31, wherein said time difference detector circuit comprises a counter for counting the tempo pulses which control the tempo of said automatic performance means and for resetting the counted value at every operation of said operator element, and an arithmetic circuit for calculating the difference between the counted value of said counter and the value designated by said note-length information at every operation of said operator element and for outputting the difference.

33. An automatic performance device according to claim 32, wherein said arithmetic circuit comprises a latch circuit for latching the calculated value only when the calculated value falls within the preset allowable value range, and delivers the latched content of said latch circuit instead of said calculated value when the calculated value exceeds the preset allowable value.

34. An automatic performance device according to claim 21, wherein said automatic performance means automatically performs an accompaniment tone.

35. An automatic performance device according to claim 34, wherein said automatic performance means automatically performs at least one type of automatic accompaniment tone selected from among an automatic rhythm tone, automatic base tone, automatic chord tone and automatic arpeggio tone.

36. An automatic performance device according to claim 21, wherein said tempo control means comprises a tempo pulse generator, and controls a tempo performed by said automatic performance means based on a tempo pulse generated from said tempo pulse generator.

37. An automatic performance device according to claim 36, wherein said tempo pulse generator comprises a voltage controlled oscillator, in which the output of said timing judgement means is converted into an analog signal which is applied to the control input thereof.

38. An automatic performance device with tempo follow-up function comprising:

memory means for storing performance timing information including note-length timing information;

an operator element;

read-out means for sequentially reading out the performance timing information from said memory means in accordance with the sequence of performance;

timing judgment means for comparing the measured time until operation of said operator element with the performance timing information read out from said memory means;

automatic performance means for performing an automatic performance; and tempo control means for controlling the tempo of the automatic performance by said automatic performance means corresponding to judgment by said timing judgment means, and wherein said tempo control means comprises a pulse generator, and controls a tempo performed by said automatic performance means based on a tempo pulse generated from said tempo pulse generator, and wherein said tempo pulse generator comprises a variable frequency divider circuit for dividing the frequency of a clock pulse, the frequency dividing ratio of said variable frequency divider circuit being set corresponding to the output of said timing judgment means.

39. An automatic performance device comprising:

memory means for storing performance timing information and pitch information;

a keyboard;

read-out means for sequentially reading said performance timing information and pitch information in accordance with the sequence of the performance;

indicating means for indicating a key to be operated in response to the pitch information read out from said readout means;

timing judgment means for comparing the actual measured time until operation of the key of said keyboard with the performance timing information read out from said memory means;

automatic performance means; and tempo control means for controlling the tempo of automatic performance by said automatic performance means in response to the results of the comparison of said timing judgment means.

40. An automatic peformance device according to claim 39, wherein said indicating means comprises light emitting devices corresponding to each key, and said light emitting devices are respectively arranged at a predetermined location on the corresponding keys.

41. An automatic performance device according to claim 39, wherein said indicating means comprises light emitting devices corresponding to each key, and said light emitting devices are respectively arranged in the vicinities of the corresponding keys.

42. An automatic performance device comprising:

memory means for storing performance timing information and pitch information;

a keyboard;

read-out means for sequentially reading out said performance timing information and pitch information from said memory means in accordance with the sequence of performance;

musical tone generating means for generating a musical tone corresponding to and in response to the pitch information thus read out from said read-out means;

timing judgment means for comparing the actual measured time until operation of the key of said keyboard with the performance timing information read out from said memory means;

automatic performance means; and tempo control means for controlling the tempo of automatic performance by said automatic performance means in response to the results of the comparison by said timing judgment means.

43. An automatic performance device comprising:

memory means for storing performance timing information;

an operator element;

read-out means for sequentially reading out the performance timing information from said memory means in accordance with a sequence of performance;

timing judgment means for comparing the actual measured time until operation of said operator element with the performance timing information thus read out from said memory means;

detecting means for detecting the relative time of occurrence of the operation of said operator element with respect to a reference timing designated by the performance timing information read out from said memory means;

automatic performance means;

tempo control means for controlling the tempo of the automatic performance by said automatic performance means in response to the results of the detection by said detecting means; and automatic performance progress control means for controlling the progress of automatic performance by said automatic performance means in response to the results of the comparison by said timing judgment means.

44. An automatic performance device according to claim 43, wherein said timing judgment means comprises a counter for counting a clock pulse for a period from the read-out time point of performance timing information read out by the read-out means to the operating time point of an operator element to be operated next, and a comparator for comparing the counted value of said counter with the performance timing information.

45. An automatic performance device according to claim 44, wherein said clock pulse is a tempo pulse for controlling the tempo of the automatic performance of said automatic performance means, and said tempo pulse is controlled by said tempo control means.

46. An automatic performance device according to claim 43, wherein said automatic performance progress control means comprises automatic performance stop means for stopping the automatic performance by said automatic performance means when said timing judgment means detects the fact that said operator element has not yet been operated at the time designated by said performance timing information.

47. An automatic performance device according to claim 46, wherein said automatic performance means comprises a tempo counter for counting a tempo pulse, the progress of automatic performance by said automatic performance means being controlled in response to the counted value of said tempo counter, and said automatic performance stop means inhibits the supply of the tempo pulse to said tempo counter.

48. An automatic performance device according to claim 43, wherein said automatic performance progress control means comprises an automatic performance quick feeding device for quickly advancing the automatic performance by said automatic performance means when said timing judgment means detects the fact that operation of said operator element occurs before the designated timing of said performance timing information.

49. An automatic performance device according to claim 48, wherein said automatic performance means comprises a tempo counter for counting a tempo pulse, the continuation of automatic performance by said automatic performance means being controlled in response to the counted value of said tempo counter, and said automatic performance quick feeding device switches the frequency of the tempo pulses counted by said tempo counter to a higher value.

50. An automatic performance device according to claim 48, wherein said automatic performance means comprises a tempo counter for counting a tempo pulse, the progress of automatic performance being controlled in response to the counted value of said tempo counter, and said automatic performance quick feeding device presets said tempo counter to a quick feed target value.

51. An automatic performance device comprising:

memory means for storing note-length information and pitch information corresponding to a series of notes representative of musical tones;

a keyboard;

read-out means for sequentially reading out the note-length information and pitch information from said memory means in accordance with the sequence of performance;

musical tone generating means for generating musical tones in response to the pitch information read out from said read-out means;

timing judgment means for judging the operating timing of the key of said keyboard based on the note-length information read out from said memory means;

tempo signal generating means for generating a tempo signal corresponding to judgment by said timing judgement means; and note-length counting means for measuring the time corresponding to the note-length information by counting the tempo signal to control said read-out means.

52. An automatic performance device comprising:

memory means for storing note-length information and pitch information corresponding to a series of notes representative of musical tones;

a keyboard;

read-out means for sequentially reading out the note-length information and pitch information from said memory means in accordance with the sequence of performance;

indicating means for indicating a key to be operated in response to the pitch information read out from said read-out means;

timing judgement means for judging the operating timing of a key of said keyboard based on the note-length information read out from said memory means;

tempo signal generating means for generating a tempo signal corresponding to judgment by said timing judgment means; and note-length counting means for measuring the time corresponding to the note-length information by counting the tempo signal to control said read-out means.

53. An automatic performance device comprising:

memory means for storing performance timing information; an operator element;

read-out means for sequentially reading out the performance timing information from said memory means based on the operation of said operator elements in accordance with a sequence of performance;

detecting means for detecting the relative time of occurrence of the operation of said operator element with respect to a reference timing designated by the performance timing information read out from said memory means;

automatic performance means; and automatic performance progress control means for controlling the progress of the automatic performance by said automatic performance means in response to the detected output of said detecting means;

wherein said detecting means comprises a counter for counting clock pulses for a period from the time that the performance timing information is read out by said read-out means to the next operator element operating time, and a comparator for comparing the counted value of said counter with said performance timing information; and wherein said clock pulses are tempo pulses for controlling the tempo of the automatic performance of said performance means, and the frequency of said tempo pulses is controlled based on the time of operation of said operator element as indicated by said detecting means.

54. An automatic performance device according to claim 53, wherein said memory means stores note-length information of musical tones to be performed as the performance timing information.

55. An automatic performance device according to claim 53, wherein said operator element is any of keys of said keyboard.

56. An automatic performance device according to claim 53, wherein said read-out means reads out the performance timing information based on a key-on signal generated in response to the operation of said operator element.

57. An automatic performance device according to claim 53, wherein said automatic performance progress control means comprises automatic performance stop means for stopping the automatic performance by said automatic performance means when said detecting means detects the fact that said operator element has not yet been operated at the time designated by said performance timing information.

58. An automatic performance device according to claim 57, wherein said automatic performance means comprises a tempo counter for counting a tempo pulse, the progress of automatic performance by said automatic performance means being controlled in response to the counted value of said tempo counter, and said automatic performance stop means inhibits the supply of the tempo pulse to said tempo counter.

59. An automatic performance device comprising:

memory means for storing performance timing information in accordance with a sequence of performance;

a manually operable operator element read-out means for sequentially reading out the performance timing information from said memory means;

detecting means for comparing the measured time until operation of said operator element with a reference timing designated by the performance timing information read out from said memory means;

automatic performance means; and automatic performance progress control means for controlling the progress of the automatic performance by said automatic performance means in response to the results of said comparison by said detecting means;

wherein said automatic performance progress control means comprises an automatic performance quick feeding device for quickly advancing the progress of the automatic performance by said automatic performance means when the time of manual operation of said operator element occurs proir to the time designated by said performance timing information, as determined by said detecting means.

60. An automatic performance device according to claim 59, wherein said automatic performance means comprises a tempo counter for counting a tempo pulse, the continuation of automatic performance by said automatic performance means being controlled in response to the counted value of said tempo counter, and said automatic performance quick feeding device switches the frequency of the tempo pulses counted by said tempo counter to a higher value.

61. An automatic performance device according to claim 59, wherein said automatic performance means comprises a tempo counter for counting a tempo pulse, the progress of automatic performance being controlled in response to the counted value of said tempo counter, and automatic performance quick feeding device presets said tempo counter to a quick feed target value.

62. An automatic performance device comprising:

a keyboard;

memory means for storing pitch information and tone-length information corresponding to tones to be performed sequentially and manually on said keyboard;

read-out means for sequentially reading out said pitch information and tone-length information from said memory means prior to the performance of the tones corresponding thereto;

automatic performance means for independently carrying out a predetermined automatic performance to accompany said manual performance in accordance with said read out information; and automatic performance stop means for stopping the automatic performance in synchronism with a time designated by said tone-length information if the key corresponding to the tone next to be manually performed, as designated by said pitch information, is not operated by said designated time, and for maintaining the stopped state until said corresponding key is operated.

63. An automatic performance device according to claim 62, wherein said automatic performance stop means comprises a counter for counting clock pulses taking the time point of reading out of the tone-length information by said read-out means as a count starting point, and a memory circuit set to one state when the counted value of said counter coincides with said tone-length information and said corresponding key is not yet operated, and set to the other state by the operation of said corresponding key, and wherein the automatic performance carried out by said automatic performance means is stopped and controlled based on the output of said memory circuit.

64. An automatic performance device according to claim 62, wherein said tones to be performed are melody tones.

65. An automatic performance device according to claim 62, wherein said automatic performance means comprises a tempo counter for counting tempo pulses, the carrying out of the automatic performance by said automatic performance means being controlled in response to the counted value of said tempo counter, and said automatic performance stop means inhibits the supply of the tempo pulses to said tempo counter.

66. An automatic performance device according to claim 62, wherein said automatic performance means automatically performs at least one automatic performance tone selected from among an automatic rhythm tone, automatic bass tone, automatic chord tone and automatic arpeggio tone.

67. An automatic performance device according to claim 62, wherein said automatic performance means automatically performs a musical tone in response to the pitch information and tone-length information read out by said read-out means.

68. An automatic performance device comprising:

a keyboard;

memory means for storing pitch information and tone-length information corresponding to tones to be performed manually in a performance sequence on said keyboard;

read-out means for sequentially reading out the tone-length information from said memory means and reading out the pitch information prior to the performance of the tones corresponding thereto;

indicating means for indicating a key to be operated in response to the pitch information read out from said read-out means;

automatic performance means for independently carrying out a predetermined performance to accompany said manual performance in accordance with said read out information; and automatic performance stop means for stopping the automatic performance in synchronism with a time designated by said tone-length information if the key corresponding to the tone next to be manually performed, as designated by said pitch information, is not operated by said designated time, and for maintaining the stopped state until said corresponding key is operated.

69. An automatic performance device according to claim 68, wherein said indicating means comprises light emitting devices corresponding to each key and said light emitting devices are respectively arranged at a predetermined location on the corresponding keys.

70. An automatic performance device according to claim 68, wherein said indicating means comprises light emitting devices corresponding to each key and said light emitting devices are respectively arranged in the vicinities of the corresponding keys.

71. An automatic performance device comprising:

memory means for storing pitch information and tone-length information corresponding to tones to be manually performed in a performance sequence;

read-out means for sequentially reading out the tone-length information from said memory means and reading out and indicating the pitch information prior to the performance of the tones corresponding thereto;

a keyboard;

key depression detecting means for detecting a key depressed on said keyboard; and read-out timing correcting means for controlling said read-out means to delay readout until a time designated by said tone-length information has elapsed in the event that the key corresponding to the tone next to be manually performed, as designated by the indicated pitch information, is depressed before said designated time and to then continue the read-out of said memory means in synchronism with an output of said key depression detecting means when said corresponding key is operated later than said designated time.

72. An automatic performance device according to claim 71, wherein said read-out timing correcting means comprises a counter for counting a clock pulse for a period from the time point of reading out the tone-length information by said read-out means to the time point of depressing said corresponding key next to be performed, as designated by the pitch information, and a comparator for comparing the counted value of said counter with the tone-length information, and determines the relative occurrence time of depression of said corresponding key with respect to said designating time based on the output from said comparator.

73. An automatic performance device according to claim 72, wherein said read-out timing correcting means comprises switching means for switching said clock pulse to a higher frequency when said key next to be performed is depressed before the time designated by said tone-length information.

74. An automatic performance device according to claim 71, wherein the tone to be performed is a melody tone.

75. An automatic performance device comprising:

memory means for storing pitch information and tone-length information corresponding to musical tones to be manually performed in a performance sequence;

read-out means for sequentially reading out the tone-length information from said memory means and reading out the pitch information prior to the performance of the tones corresponding thereto;

a keyboard;

indicating means for indicating a key to be operated in response to the pitch information read out from said read-out means;

key depression detecting means for detecting a key which is depressed on said keyboard; and read-out timing correcting means for controlling said read-out means to delay read-out until a time designated by said tone-length information has elapsed in the event that the key corresponding to the tone next to be performed, as indicated by said indicating means, is depressed before said designated time and to then continue the read-out of said memory means, beginning at an occurrence of an output of said key depression detecting means when said corresponding key is operated after said designated time.

76. An automatic performance device according to claim 75, wherein said indicating means comprises light emitting devices corresponding to each key and said light emitting devices are respectively arranged at a predetermined location on the corresponding keys.

77. An automatic performance device according to claim 75, wherein said indicating means comprises light emitting devices corresponding to each key and said light emitting devices are respectively arranged in the vicinities of the corresponding keys.

* * * * *